US008936233B1

(12) United States Patent
Sneith

(10) Patent No.: US 8,936,233 B1
(45) Date of Patent: Jan. 20, 2015

(54) BALUSTER BRACKET ASSEMBLY

(76) Inventor: Jayme M. Sneith, Scenery Hill, PA (US)

( * ) Notice: Subject to any disclaimer, the term of this patent is extended or adjusted under 35 U.S.C. 154(b) by 28 days.

(21) Appl. No.: 13/618,304

(22) Filed: Sep. 14, 2012

Related U.S. Application Data

(63) Continuation-in-part of application No. 13/400,262, filed on Feb. 20, 2012.

(51) Int. Cl.
*E04H 17/14* (2006.01)

(52) U.S. Cl.
USPC ..... 256/67

(58) Field of Classification Search
USPC ..... 256/65.01–65.03, 65.06, 65.07, 65.12, 256/65.14, 67
See application file for complete search history.

(56) References Cited

U.S. PATENT DOCUMENTS

| | | | | | |
|---|---|---|---|---|---|
| 684,451 | A | * | 10/1901 | Mowry | 403/87 |
| 1,772,159 | A | * | 8/1930 | Roth | 256/65.08 |
| 3,174,727 | A | | 3/1965 | Burt et al. | |
| 3,482,819 | A | | 12/1969 | Leurent | |
| 3,648,982 | A | * | 3/1972 | Sabel et al. | 256/65.05 |
| 3,733,055 | A | * | 5/1973 | Hughes, Jr. | 256/59 |
| 4,408,749 | A | * | 10/1983 | Zieg | 256/67 |
| 4,805,879 | A | | 2/1989 | Spera | |
| 4,886,245 | A | * | 12/1989 | Manzo | 256/67 |
| 5,029,820 | A | | 7/1991 | Katz | |
| 5,131,197 | A | * | 7/1992 | Varga | 52/183 |
| 5,575,580 | A | | 11/1996 | Parrish et al. | |
| 5,873,671 | A | | 2/1999 | West | |
| 6,305,670 | B1 | | 10/2001 | Ward et al. | |
| 6,471,192 | B1 | | 10/2002 | Erwin | |
| 6,543,751 | B1 | | 4/2003 | Sprull | |
| 6,643,982 | B1 | | 11/2003 | Lapp, Jr. et al. | |
| 6,736,373 | B2 | * | 5/2004 | Greaves | 256/65.16 |
| 6,758,460 | B1 | | 7/2004 | Driscoll et al. | |
| 6,805,335 | B2 | | 10/2004 | Williams | |
| 6,948,283 | B2 | | 9/2005 | Burkart et al. | |
| 7,077,386 | B1 | | 7/2006 | Gray, Jr. et al. | |
| 7,104,525 | B2 | | 9/2006 | Ricci | |
| 7,178,791 | B1 | | 2/2007 | Gray, Jr. et al. | |
| D547,463 | S | | 7/2007 | Gross et al. | |
| 7,243,473 | B2 | | 7/2007 | Terrels | |
| 7,427,055 | B2 | | 9/2008 | Platt | |
| 7,530,550 | B2 | | 5/2009 | Fattori | |
| 7,722,014 | B2 | | 5/2010 | Goodwin | |
| 7,744,065 | B2 | | 6/2010 | Terrels et al. | |
| 7,971,412 | B1 | * | 7/2011 | Lim | 52/832 |
| 8,033,530 | B2 | * | 10/2011 | Timothy | 256/22 |
| D667,964 | S | * | 9/2012 | Chung | D25/133 |
| D673,306 | S | * | 12/2012 | Chung | D25/133 |
| 8,356,803 | B2 | * | 1/2013 | Truckner | 256/67 |
| 2007/0246698 | A1 | * | 10/2007 | Truckner et al. | 256/67 |
| 2009/0278106 | A1 | * | 11/2009 | Truckner | 256/67 |
| 2013/0020546 | A1 | * | 1/2013 | Truckner | 256/65.02 |

* cited by examiner

*Primary Examiner* — Michael P Ferguson
*Assistant Examiner* — Daniel Wiley
(74) *Attorney, Agent, or Firm* — Robert C. Montgomery; Montgomery Patent Design

(57) ABSTRACT

A baluster bracket assembly including a pair of mounting brackets attached to facing surfaces of a handrail and a base-rail for retaining a baluster in railing construction. Each mounting bracket includes a mounting plate fastened to the railing surface and a collar for receiving an end of the baluster. A shoe is provided with each mounting bracket for attachment to the end of the baluster and for covering the mounting bracket after installation.

5 Claims, 22 Drawing Sheets

BALUSTER BRACKET ASSEMBLY

RELATED APPLICATIONS

Continuation-in-part of application Ser. No. 13/400,262 filed on Feb. 20, 2012.

FIELD OF THE INVENTION

The present invention relates generally to railing construction, and in particular, to a baluster bracket assembly for the attachment of balusters between handrails and baserails in applications utilizing railing systems.

BACKGROUND OF THE INVENTION

A requirement for almost all walking-working surfaces is that every open-sided floor or platform four feet (4 ft.) or more above an adjacent floor or ground level shall be guarded by a railing on all open sides, except where there is an entrance to a ramp, stairway, or fixed ladder. The open space between a handrail and the floor surface is often filled by a plurality of spaced apart balusters. Most installers prefer to install balusters after the handrail is installed. The general consensus is that it is easier to adjust baluster position to fit the handrail than it is to measure, cut, fit, and attach both the handrail and the balusters at the same time.

Whether using metal or wooden balusters, traditionally holes are drilled into the baserail or floor surface and into the handrail at the appropriate spacing for receiving the ends of the baluster. At least one (1) of the holes in the support rails, typically that of the baserail, is drilled deep and the baluster is cut longer than necessary in order to fit within the set space between the handrail and the baserail. Once positioned within the prepared holes, the baluster must be glued or epoxied within the drilled hole and left for a minimum of twenty-four hours (24 hrs.) to dry. The baluster must also be secured into position while the glue or epoxy dries. This process is messy. Furthermore if the baluster shifts position before the glue has dried, the glue must be chiseled out and the baluster must be removed and reattached. Other difficulties occur due to the ends of most balusters having a square cross-sectional shape, which forces the installer to drill holes large enough to receive the square end or chisel out a square hole. Each of these solutions presents significant drawbacks.

Additionally, when installing balusters to sloped support rails additional time and care must be given to ensure proper alignment and fit. Furthermore, if at any time the balusters become damaged or need to be replaced, the baluster must be cut out from the railing system and the ends and epoxy removed from the holes. This process can likely damage both the handrail and the baserail causing additional problems.

Addressing these problems has provided various attachment assemblies intended to support railing systems and attach balusters or similar support posts. Unfortunately, the hardware and methods presently available still require the drilling of large holes or utilize mechanical fasteners that are exposed, which can be unsightly and diminish the appearance of the otherwise decorative railing system. Despite any advances already in the field, those skilled in the art continue with research and development efforts directed to apparatus and methods for railing construction products.

SUMMARY OF THE INVENTION

The inventor has recognized the aforementioned inherent problems and lack in the art and observed that there is a need for an apparatus and method to attach balusters between handrails and baserails which does not require the drilling of large holes, the use of an adhesive agent, or otherwise detract from the appearance of the railing system. Additionally, it has been recognized that an apparatus and method are needed that reduces the cost and labor involved in the construction, repair, and replacement of railing systems. The development of the present invention, which will be described in greater detail herein, substantially departs from conventional solutions to provide a new baluster bracket assembly and in doing so fulfills this need.

The inventor has addressed this need by developing a baluster bracket assembly and method for installation and attachment of balusters to a railing system. The disclosed baluster bracket assembly can include a mounting plate configured to attach to a railing support surface and a collar disposed on said mounting plate, said collar configured to receive and secure a baluster.

In an embodiment, the disclosed baluster bracket assembly can include a collar having three (3) side walls extending perpendicularly from the mounting plate to retain the baluster perpendicularly relative to the mounting plate, an open side suitably sized to insertably receive an end of the baluster, and an interior area defined by the side walls having a shape corresponding equivalently to a cross-sectional shape of the end of the baluster. The disclosed baluster bracket assembly can also include a shoe having a body including an open top end and an open bottom end and a hollow channel extending entirely through the body and configured to receive the end of the baluster, wherein the open bottom end covers the mounting bracket plate and the collar.

In another embodiment, the disclosed bracket assembly can include a clip attachable to laterally opposed side walls of the collar to cover the open side, wherein the clip retains the end of the baluster within the collar.

In another embodiment, the disclosed bracket assembly can include a collar having a rear wall extending angularly from the mounting plate and two (2) lateral side walls perpendicular to the rear wall to retain the baluster at an angle other than perpendicular relative to the mounting plate, an open side suitably sized to insertably receive an end of the baluster, and an interior area defined by the rear wall and the side walls having a shape corresponding equivalently to a cross-sectional shape of the end of the baluster. A shoe can include a body having an open top end and an open bottom end and a hollow channel extending entirely through the body and configured to receive the end of the baluster, wherein the open bottom end is angled and covers the mounting bracket plate and the collar.

In another embodiment, the disclosed baluster bracket assembly can include a collar having four side walls extending perpendicularly to the mounting plate to retain the baluster perpendicularly relative to the mounting plate and an interior area defined by the side walls having a shape corresponding equivalently to a cross-sectional shape of the end of the baluster. A shoe can include a body having an open top end and an open bottom end and a hollow channel extending entirely through the body and configured to receive the end of the baluster, wherein the open bottom end covers the mounting bracket plate and the collar.

In another embodiment, the disclosed baluster bracket assembly can include a bottom wall, three (3) side walls extending perpendicularly from the bottom wall to retain the baluster, an open side suitably sized to insertably receive an end of the baluster, an interior area defined by the side walls having a shape corresponding equivalently to a cross-sectional shape of the end of the baluster, and a support member extending perpendicularly from the bottom surface opposite the side walls, the support member pivotally attached to the mounting plate. A shoe can include a body having an open top end and an open bottom end and a hollow channel extending entirely through the body and configured to receive the end of the baluster, wherein the open bottom end is angled and covers the mounting bracket plate and the collar. A clip can be attachable to laterally opposed side walls of the collar to cover the open side, wherein the clip retains the end of the baluster within the collar.

In another embodiment, the disclosed baluster bracket assembly can include a collar having a bottom wall, four (4) side walls extending perpendicularly from the bottom wall to retain the baluster, an interior area defined by the side walls having a shape corresponding equivalently to a cross-sectional shape of the end of the baluster, and a support member extending perpendicularly from the bottom surface opposite the side walls, the support member pivotally attached to the mounting plate. A shoe can include a body having an open top end and an open bottom end and a hollow channel extending entirely through the body and configured to receive the end of the baluster, wherein the open bottom end is angled and covers the mounting bracket plate and the collar.

In another embodiment, the disclosed baluster bracket assembly can include a mounting plate having a mounting member extending upwardly from a top surface. The mounting plate can be pivotally attached to the collar, such that the baluster is adjustably positioned relative to the handrail and the baserail.

In another embodiment, the disclosed bracket assembly can include a clip having a rear wall and two (2) lateral sidewalls perpendicular to the rear wall defining an open interior, the open interior can be suitably sized to receive the collar such that the lateral side walls surround the lateral side walls of the collar and the rear wall covers the open side to retain the baluster within the collar.

In an implementation of the disclosed baluster bracket assembly, the mounting bracket can be used to couple an end of the baluster to the handrail or baserail, such that the baluster can be retained in a generally vertical oriented. In another implementation, a plurality of the disclosed baluster bracket assemblies can be utilized during railing construction to couple a plurality of balusters between the opposed handrail and baserail, such that each baluster can be retained in a generally vertical orientation. In such an implementation, each of the disclosed baluster bracket assemblies can include a pair of mounting brackets, a pair of shoes, and at least one baluster for fastening the baluster between opposingly facing surfaces of the handrail and the baserail. The plurality of baluster bracket assemblies can be used to construct a railing system having a plurality of vertically oriented balusters fastened between opposingly facing surfaces of a horizontal handrail and a horizontal baserail, a sloped handrail and a horizontal baserail, or a sloped handrail and a sloped baserail.

Furthermore, the described features and advantages of the disclosed baluster bracket assembly may be combined in various manners and embodiments as one skilled in the relevant art will recognize after reading the present disclosure. The disclosure can be practiced without one (1) or more of the features and advantages described in any particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
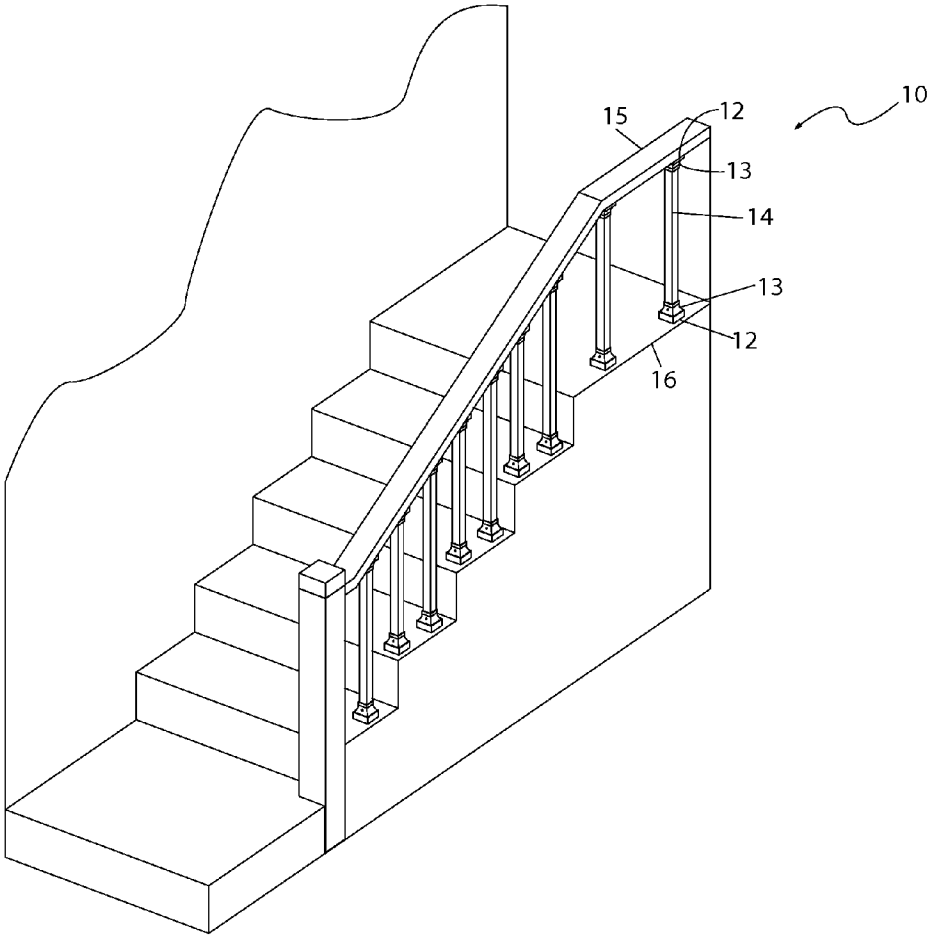
FIG. 1 is an environmental view of an implementation of a plurality of baluster bracket assemblies depicted in a stair and railing construction.

10 baluster bracket assembly
12 mounting bracket
13 shoe
14 baluster
15 handrail
16 baserail

17 baluster upper end
18 baluster lower end
19 baluster fastening aperture
20 mounting bracket
21 mounting plate
22 rail mounting surface
23 baluster mounting surface
24 collar
25 side wall
26 interior area
27 open side
28 aperture
29 aperture
30 shoe
31 channel
32 top end
33 bottom end
34 aperture
40 fastener
41 fastener
42 set screw
120 mounting bracket
121 mounting plate
122 rail mounting surface
123 baluster mounting surface
124 collar
125 side wall
126 interior area
127 open side
128 aperture
129 rear wall
130 shoe
131 channel
132 top end
133 bottom end
134 aperture
140 fastener
141 fastener
150 clip
151 side wall
152 open side
153 interior area
154 protrusion
155 slot
156 rear wall
220 mounting bracket
221 mounting plate
222 rail mounting surface
223 baluster mounting surface
224 collar
225 side wall
226 interior area
227 open side
228 aperture
229 aperture
230 shoe
231 channel
232 top end
233 bottom end
234 aperture
240 fastener
241 fastener
242 set screw
243 rear wall
320 mounting bracket
321 mounting plate
322 rail mounting surface
323 baluster mounting surface
324 collar
325 side wall
326 interior area
327 open side
328 aperture
330 shoe
331 channel
332 top end
333 bottom end
334 aperture
335 rear wall
340 fastener
341 fastener
349 rear wall
350 clip
351 side wall
352 open side
353 interior area
354 protrusion
355 slot
356 mounting member
357 support member
358 aperture
359 side plate
360 aperture
361 pivot member
362 bottom wall

DETAILED DESCRIPTION OF THE PREFERRED EMBODIMENT

In accordance with the invention, the best mode is presented in terms of described embodiments, herein depicted within FIGS. 1 through 25. However, the disclosure is not limited to the described embodiments and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only certain configurations have been shown and described for purposes of clarity and disclosure and not by way of limitation of scope.

It can be appreciated that, although such terms as first, second, etc. may be used herein to describe various elements, these elements should not be limited by these terms. These terms are only used to distinguish one (1) element from another element. Thus, a first element discussed below could be termed a second element without departing from the scope of the present invention. In addition, as used herein, the singular forms "a", "an" and "the" are intended to include the plural forms as well, unless the "comprising" or "comprises" is open-ended, and includes one or more stated elements, steps or functions without precluding one or more unstated elements, steps or functions. Relative terms such as "front" or "rear" or "left" or "right" or "top" or "bottom" or "below" or "above" or "upper" or "lower" or "horizontal" or "vertical" may be used herein to describe a relationship of one (1) element, feature or region to another element, feature or region as illustrated in the figures. It should be understood that these terms are intended to encompass different orientations of the device in addition to the orientation depicted in the figures. It should also be understood that when an element is referred to as being "connected" to another element, it can be directly connected to the other element or intervening elements may be present. In contrast, when an element is referred to as being "directly connected" to another element, there are no intervening elements present. It should also be understood that the sizes and relative orientations of the illustrated elements are not shown to scale, and in some instances they have been exaggerated for purposes of explanation.

Referring now to FIGS. 1 through 25, which disclose a baluster bracket assembly (herein generally described as an "assembly") 10 and a method of use thereof, where like reference numerals represent similar or like parts. In accordance with the invention, the present disclosure describes an assembly 10 and method for attaching a baluster 14 between a handrail 15 and a stair, floor, or similar baserail 16 during stair construction.

Referring first to FIG. 1, which depicts a plurality of assemblies 10 in use for railing construction of inside or outside staircases, landings, balconies, decks, and any other types of platforms that require a form of barrier for safety or cosmetic reasons. Each assembly 10 can generally include a pair of mounting brackets, generally designated 12, fastened to a bottom surface of the handrail 15 and to an opposingly facing, top surface of the baserail 16; a baluster 14 retained to the mounting brackets 12 between the handrail 15 and the baserail 16, and a pair of covering shoes, generally designated 13, connected opposing ends of the baluster 14 to cover the mounting brackets 12. The mounting bracket 12 can be made from any suitable durable and lightweight material, such as metal or polystyrene plastic in a stamping or molding process.

A plurality of assemblies 10 can be used to attach a plurality of spindles or balusters 14 (the term baluster is used throughout this disclosure), which act as an infill between the handrail 15 and the baserail 16. In the implementation illustrated in FIG. 1, the baserail 16 is the outer stringer of a staircase. It can be appreciated by one skilled in the art that the baserail 16 can also be the tread or horizontal top surface of the steps if used with a cut or open stringer or a landing or floor surface if used on a deck or balcony. Only a simple square baluster 14 has been illustrated in the various drawings, however, it can be appreciated by one skilled in the art that the baluster 14 can be provided in various lengths, diameters, and styles having various different exterior shapes and designs. The balusters 14 can also be made of various suitable rigid materials.

Referring next to FIGS. 2 through 5, one embodiment of the disclosed assembly 10 can include a mounting bracket 20 configured to receive an upper end 17 or lower end 18 of the baluster 14 and to support the baluster 14 between the opposing support rails 15, 16 and a covering shoe 30 slidably connected to the ends 17, 18 of the baluster 14 to cover the mounting bracket 20. During construction of the railing system, a first (i.e., upper) mounting bracket 20 can be fastened to the bottom surface of the handrail 15 and a second (i.e., lower) mounting bracket 20 can be fastened to the opposing top surface of the baserail 16 for joining each baluster 14.

Figure 2:
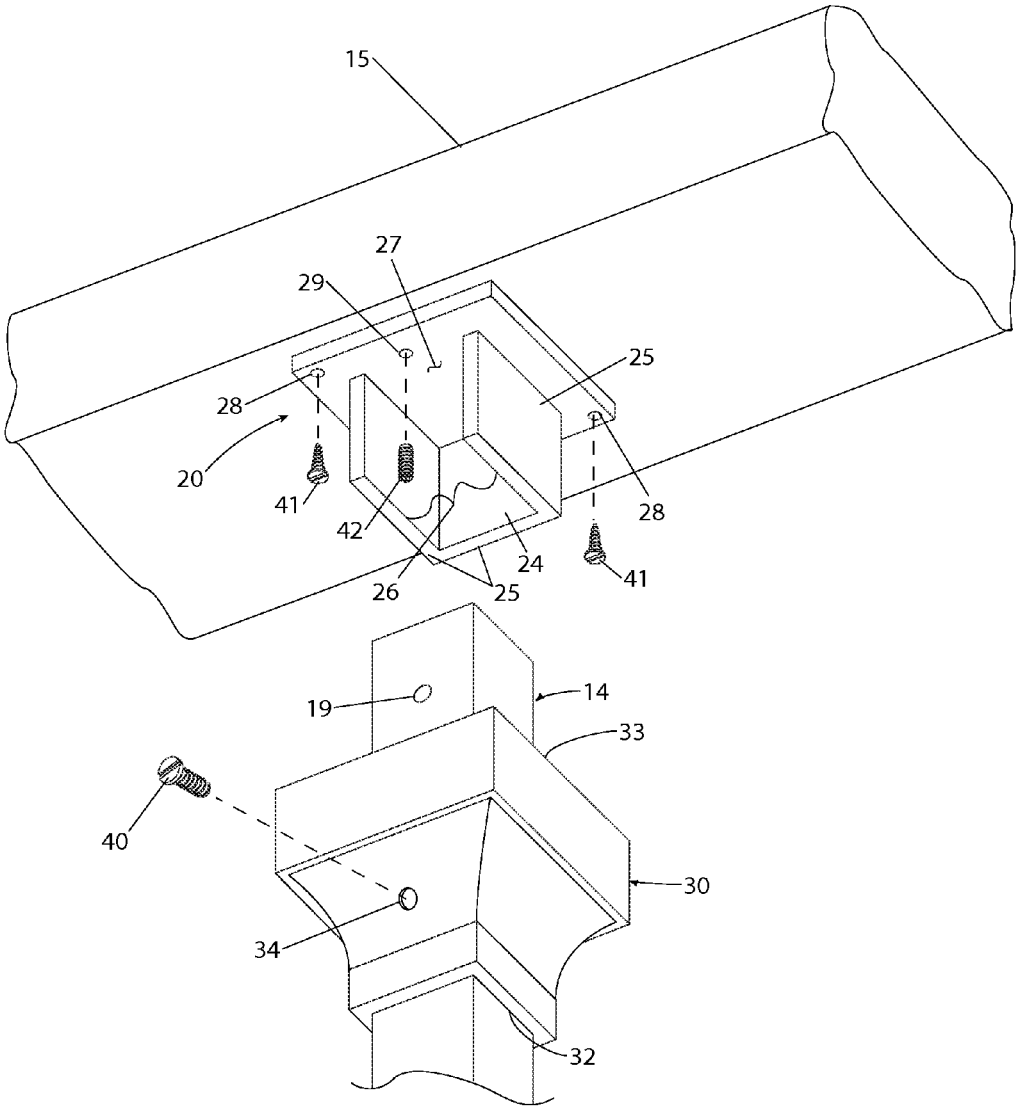
FIG. 2 is an exploded front perspective view of an embodiment of the baluster bracket assembly.
Figure 3:
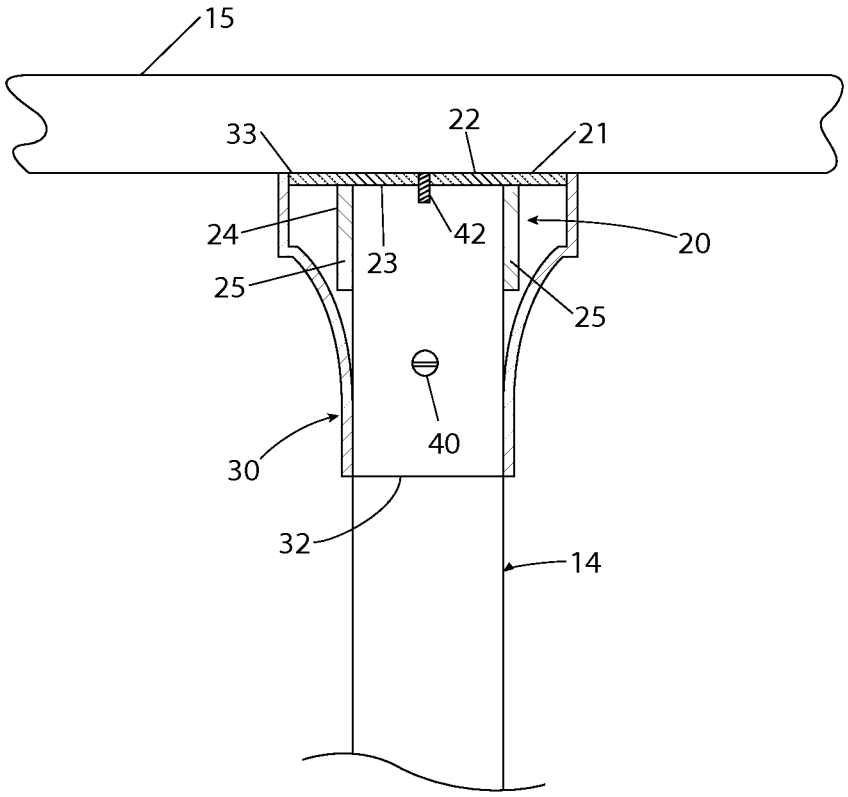
FIG. 3 is a transparent front view of the baluster bracket assembly of FIG. 2 depicted in an assembled state.
Figure 4:
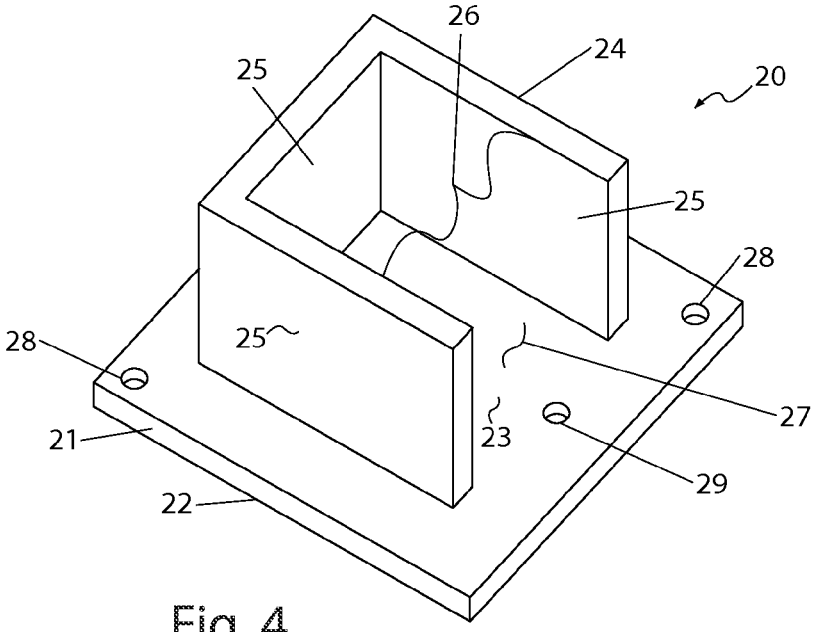
FIG. 4 is side perspective view of a mounting bracket of the baluster bracket assembly of FIG. 2.

At this point, it can be appreciated by one skilled in the art that the railing system typically includes a plurality of spaced apart balusters 14 and each baluster 14 would utilize a pair of mounting brackets 20 and a pair of shoes 30 and that only a single baluster 14 and a single mounting bracket 20 and shoe 30 are disclosed in any given illustrated embodiment since each assembly 10 can be identical with the others. It can also be appreciated by one skilled in the art that the configurations illustrated in FIGS. 2 and 3 are of the upper mounting bracket 20 and a horizontal handrail 15, and that the configuration of the lower mounting bracket 20 used with a horizontal baserail 16 (not shown) can be an inverted and substantially identical implementation of the assembly 10.

Figure 23:
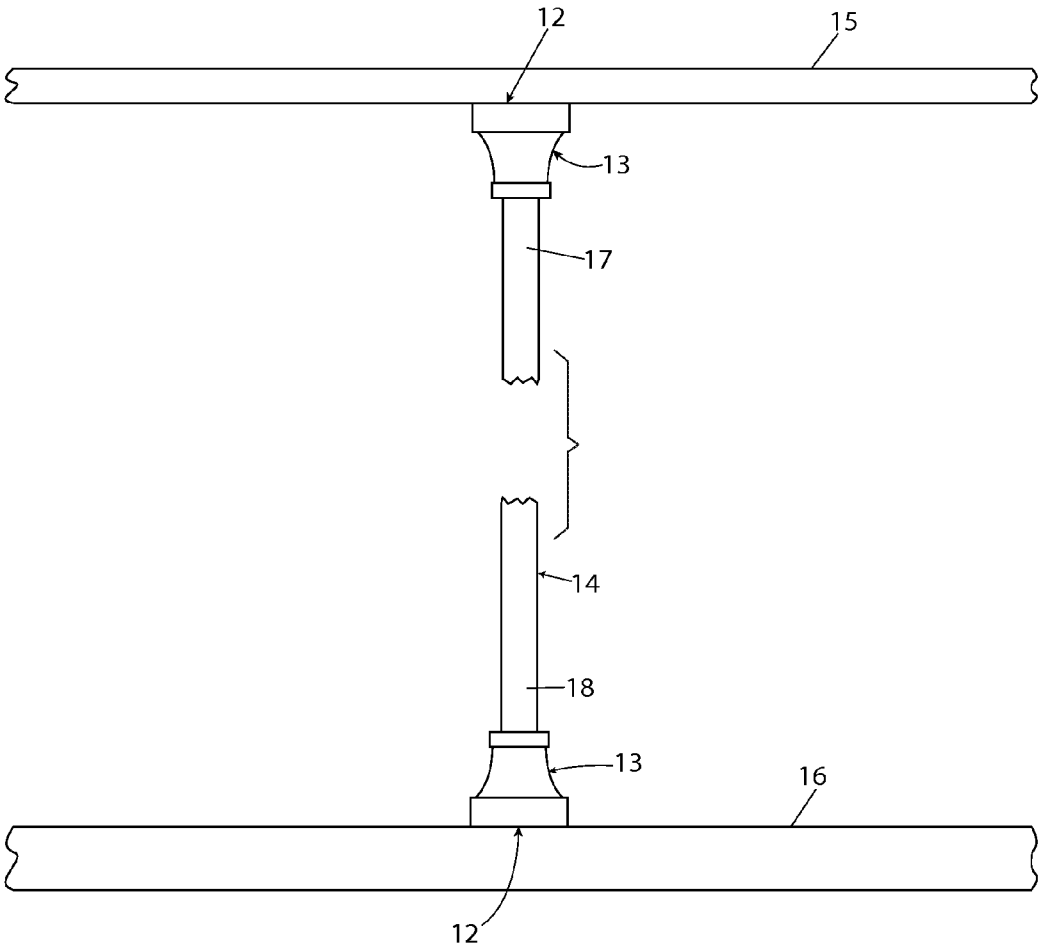
FIG. 23 is a fragmented side view of an implementation of the baluster bracket assembly depicted in use on a horizontal handrail and a horizontal baserail.

Referring still to FIGS. 2 through 5, the mounting bracket 20 can include a generally flat mounting plate 21 having an exterior rail mounting surface 22 and an interior baluster mounting surface 23. A collar 24 can extend outwardly from the baluster mounting surface 23 at a generally central location. The collar 24 can include side walls 25 defining and interior area 26 for insertably receiving an end 17, 18 of the baluster 14. For example, the collar 24 can include three (3) generally perpendicular side walls 25 and an open side 27 forming a generally square cross-sectional shape. The open side 27 can be configured to slidably receive the end 17, 18 of the baluster 14 within the interior area 26. The open side 27 of the collar 24 allows the ends 17, 18 of the baluster 14 to slide in to and out from the mounting bracket 20 when joining of the baluster 14. In another example (not shown), the collar 24 can include four (4) generally perpendicular side walls 25 to insertably receive the end 17, 18 of the baluster 14 within the interior area 26. The side walls 25 of the collar 24 can be perpendicular to the mounting plate 21. The orientation of this perpendicular collar 24 can allow for attachment of the balusters 14 in a generally vertical orientation between a horizontal handrail 15 and a horizontal baserail 16, as shown in FIG. 23.

The collar 24 can be suitably dimensioned such that the distance between interior surfaces of the side walls 25 (i.e., the interior area 26) is in close tolerance with the external dimensions of the ends 17, 18 of the baluster 14 to provide for a secure friction fit. For example, the interior area 26 of the collar 24 can have substantially the same configuration and size as the exterior surface of the ends 17, 18 of the baluster 14 and is sufficient to receive three sides of the baluster 14 (FIGS. 2 and 3). In the depicted embodiment, the collar 24 and interior area 26 can have a square shape, as most typical balusters 14 have an upper end 17 and a lower end 18 having a square cross-sectional shape. However, it can be appreciated by one skilled in the art that the sidewalls 25 of the collar 24 and interior area 26 can be formed having various sizes and geometric shapes depending on the particular style of baluster 14 being used.

The shoe 30 can include a decorative exterior and a hollow internal through channel 31 extending entirely along a longitudinal axis from a top end 32 of the shoe 30 to a bottom end 33 of the shoe 30. The exterior shape and design of the shoe 30 can vary greatly and as such the illustrated embodiment should not be viewed as a limiting factor of the present disclosure. The open top end 32 and open bottom end 33 provide insertable access to the channel 31 by the ends 17, 18 of the baluster 14, such that the shoe 30 is slidable along the length of the baluster 14. The top end 32 can be suitably sized and shaped to receive the end 17, 18 of the baluster 14, which can pass entirely through the channel 31 and extend out from the bottom end 33. The bottom end 33 can be suitably sized and shaped to receive and cover the mounting plate 21 and the collar 24.

Figure 5:
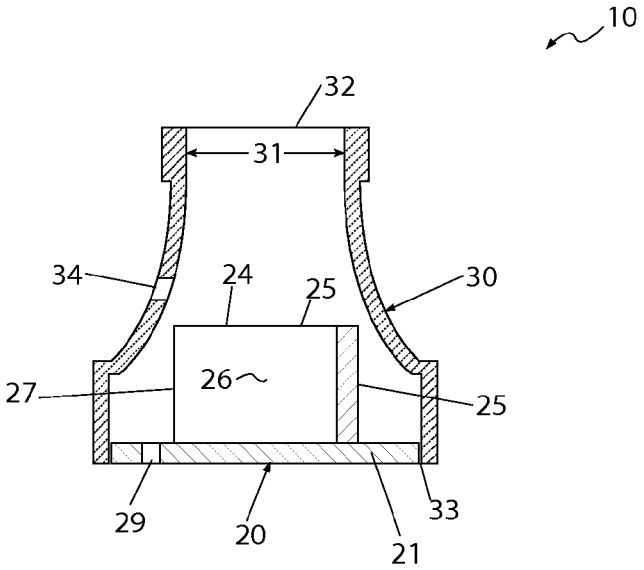
FIG. 5 is a side elevation view, in section, of the mounting bracket of FIG. 4.

The shoe 30 retains the respective ends 17, 18 of the baluster 14 within the collar 24 once positioned over and covering the mounting bracket 20. The shoe 30 can include a fastening aperture 34 disposed through a sidewall of the shoe 30. The aperture 34 can threadably receive a threaded fastener 40; the fastener 40 can extend through the sidewall of the shoe 30 and threadingly fasten to another fastening aperture 19 disposed in a side of the end 17, 18 of the baluster 14 when the apertures 19, 34 are aligned. As best seen in FIGS. 2, 3, and 5, the perpendicular shoe 30 can include a flat bottom end 33 and can be used with the perpendicular mounting bracket 20 having the perpendicular collar 24.

The mounting bracket 20 can include a plurality of fastening apertures 28 formed through opposing corners of the mounting plate 21. The apertures 28 can receive threaded fasteners 41 which extend through the mounting plate 21 and are screwed into the bottom (i.e., underside) surface of the handrail 15 or the top surface of the baserail 16 to secure the respective mounting brackets 20. The mounting brackets 20 can be fastened to the respective rails 15, 16 to securely join the balusters 14 between the rails 15, 16. The collars 24 can prevent lateral and rotational movement the balusters 14. The mounting bracket 20 can include at least one set screw aperture 29 formed through the mounting plate 21 adjacent to the open side 27 of the collar 24. The aperture 29 can receive a threaded set screw 42 which at least partially protrudes from the mounting plate 21 and provides an additional physical bather to prevent the baluster 14 from disengaging from within the collar 24 once inserted.

It can be appreciated that the rail mounting surface 23 of the mounting bracket 20 can be fastened to the support rails 15, 16 by other suitable fastening means, such as adhesives or other mechanical fastening hardware and the illustrated fasteners are not meant to limit the scope of the present disclosure. It can also be appreciated that the support rails 15, 16 can be provided with integral mounting brackets 20 longitudinally spaced apart along the respective top and bottom surfaces. The integral mounting brackets 20 can be integrally molded or affixed by any suitable manufacturing technique, such as welding, sonic welding, industrial adhesives, or the like.

Figure 6:
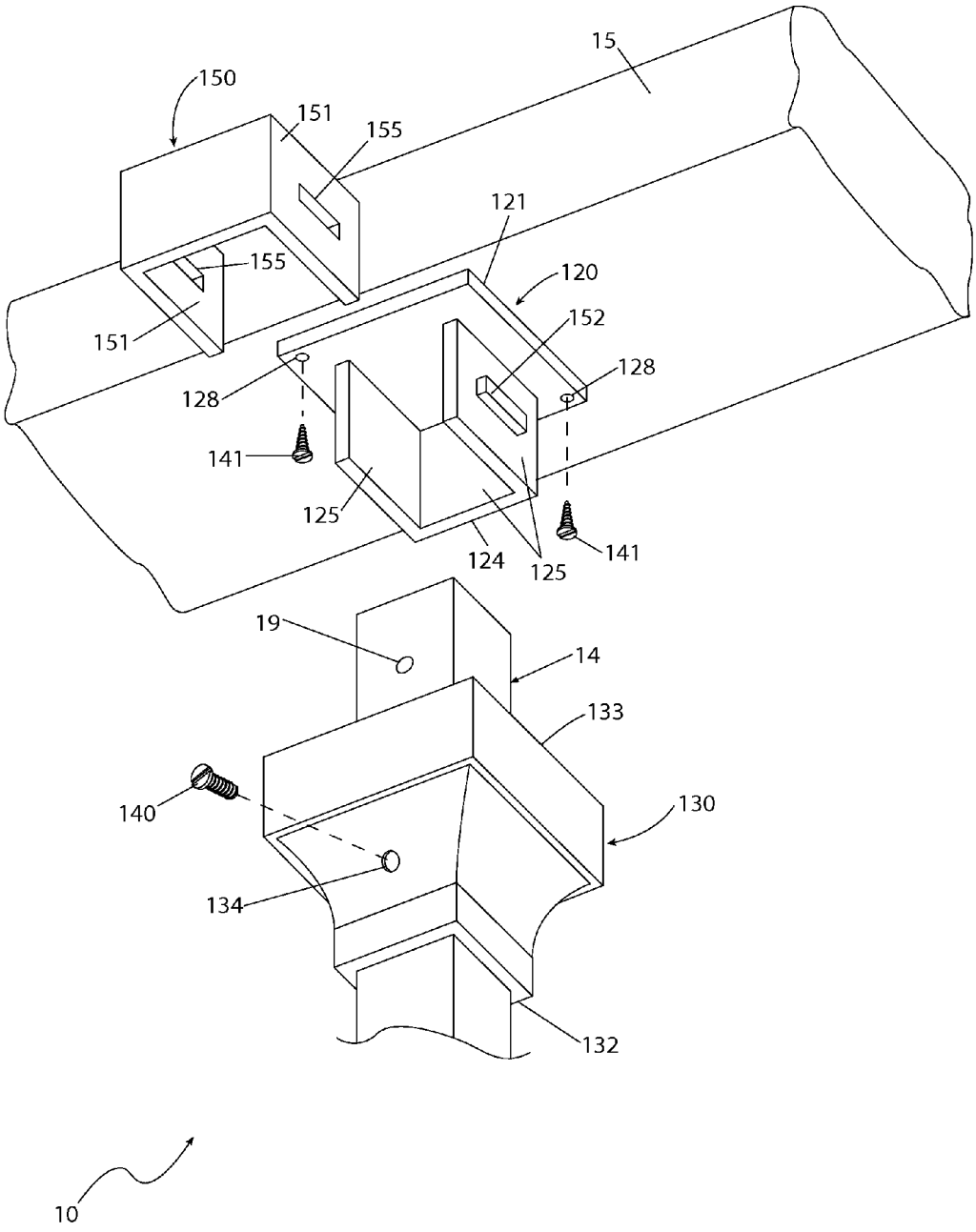
FIG. 6 is an exploded front perspective view of another embodiment of the baluster bracket assembly.
Figure 7:
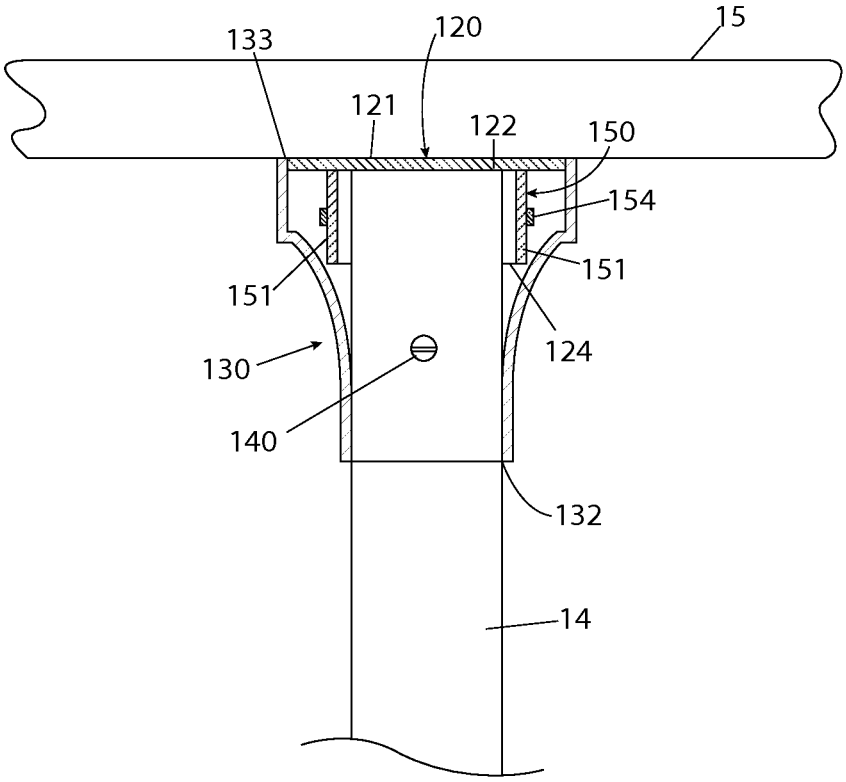
FIG. 7 is a transparent front view of the baluster bracket assembly of FIG. 6.

Referring next to FIGS. 6 through 10, another embodiment of the disclosed assembly 10 can include a mounting bracket 120 configured to receive an upper end 17 or lower end 18 of the baluster 14 and to support the baluster 14 between the opposing support rails 15, 16 and a covering shoe 130 slidably connected to the ends 17, 18 of the baluster 14 to cover the mounting bracket 120. During construction of the railing system, a first (i.e., upper) mounting bracket 120 can be fastened to the bottom surface of the handrail 15 and a second (i.e., lower) mounting bracket 20 can be fastened to the opposing top surface of the baserail 16 for joining each baluster 14. At this point, it can be appreciated by one skilled in the art that the configurations illustrated in FIGS. 6 and 7 are of the upper mounting bracket 120 and a horizontal handrail 15, and that the configuration of the lower mounting bracket 120 used with a horizontal baserail 16 (not shown) can be an inverted and substantially identical implementation of the assembly 10.

The mounting bracket 120 can include a generally flat mounting plate 121 having an exterior rail mounting surface 122 and an interior baluster mounting surface 123. A collar 124 can extend outwardly from the baluster mounting surface 123 at a generally central location. The collar 124 can include a rear wall 129 and laterally spaced apart side walls 125 defining and interior area 126 for insertably receiving an end 17, 18 of the baluster 14. For example, the collar 124 can include three generally perpendicular side walls 125 and an open side 127 forming a generally square cross-sectional shape. The open side 127 can be configured to slidably receive the end 17, 18 of the baluster 14 within the interior area 126. The open side 127 of the collar 124 allows the ends 17, 18 of the baluster 14 to slide in to and out from the mounting bracket 120 when joining of the baluster 14. Each side wall 125 of the collar 124 can be perpendicular to the mounting plate 121. The orientation of this perpendicular collar 124 can allow for attachment of the balusters 14 in a generally vertical orientation between a horizontal handrail 15 and a horizontal baserail 16, as shown in FIG. 23.

The collar 124 can be suitably dimensioned such that the distance between interior surfaces of the side walls 125 (i.e., the interior area 126) is in close tolerance with the external dimensions of the ends 17, 18 of the baluster 14 to provide for a secure friction fit. For example, the interior area 126 of the collar 124 can have substantially the same configuration and size as the exterior surface of the ends 17, 18 of the baluster 14 and is sufficient to receive three sides of the baluster 14 (FIGS. 6 and 7). In the depicted embodiment, the collar 124 and interior area 126 can have a square shape, as most typical balusters 14 have an upper end 17 and a lower end 18 having a square cross-sectional shape. However, it can be appreciated by one skilled in the art that the sidewalls 125 of the collar 124 and interior area 126 can be formed having various sizes and geometric shapes depending on the particular style of baluster 14 being used.

The shoe 130 can include a decorative exterior and a hollow internal through channel 131 extending entirely along a longitudinal axis from a top end 132 of the shoe 130 to a bottom end 133 of the shoe 130. The exterior shape and design of the shoe 130 can vary greatly and as such the illustrated embodiment should not be viewed as a limiting factor of the present disclosure. The open top end 132 and open bottom end 133 provide insertable access to the channel 131 by the ends 17, 18 of the baluster 14, such that the shoe 130 is slidable along the length of the baluster 14. The top end 132 can be suitably sized and shaped to receive the ends 17, 18 of the baluster 14, which can pass entirely through the channel 131 and extend out from the bottom end 133. The bottom end 133 can be suitably sized and shaped to receive and cover the mounting plate 121 and the collar 124.

Figure 10:
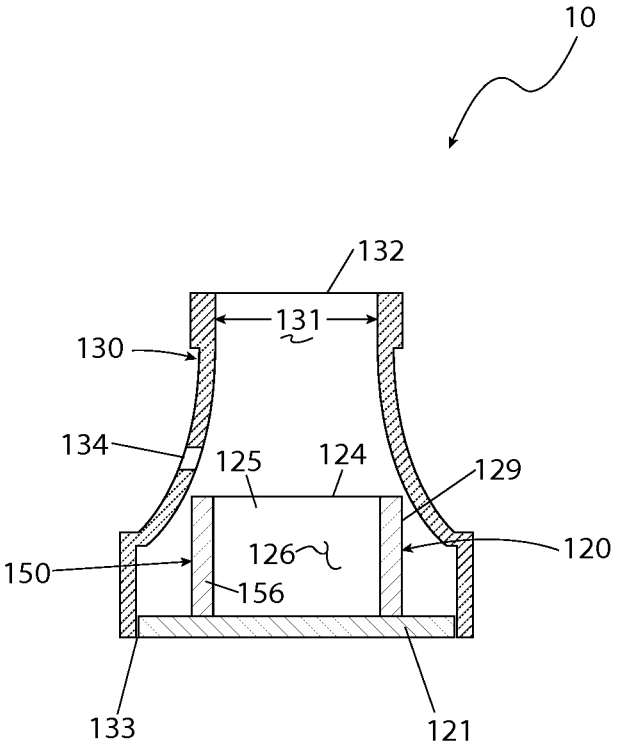
FIG. 10 is a side elevation view, in section, of the baluster bracket assembly of FIG. 6.

The shoe 130 retains the respective ends 17, 18 of the baluster 14 within the collar 124 once positioned over and covering the mounting bracket 120. The shoe 130 can include a fastening aperture 134 disposed through a sidewall of the shoe 130. The aperture 134 can threadably receive a threaded fastener 140; the fastener 140 can extend through the sidewall of the shoe 130 and threadingly fasten to another fastening aperture 19 disposed in a side of the end 17, 18 of the baluster 14 when the apertures 19, 134 are aligned. As best seen in FIGS. 6, 7, and 10, the perpendicular shoe 130 can include a flat bottom end 133 and can be used with the perpendicular mounting bracket 120 having the perpendicular collar 124.

The mounting bracket 120 can include a plurality of fastening apertures 128 formed through opposing corners of the mounting plate 121. The apertures 128 can receive threaded fasteners 141 which extend through the mounting plate 121 and are screwed into the bottom surface of the handrail 15 or the top surface of the baserail 16 to secure the respective mounting brackets 120. The mounting brackets 120 can be fastened to the respective rails 15, 16 to securely join the balusters 14 between the rails 15, 16. The collars 124 can prevent lateral and rotational movement the balusters 14.

Figure 8:
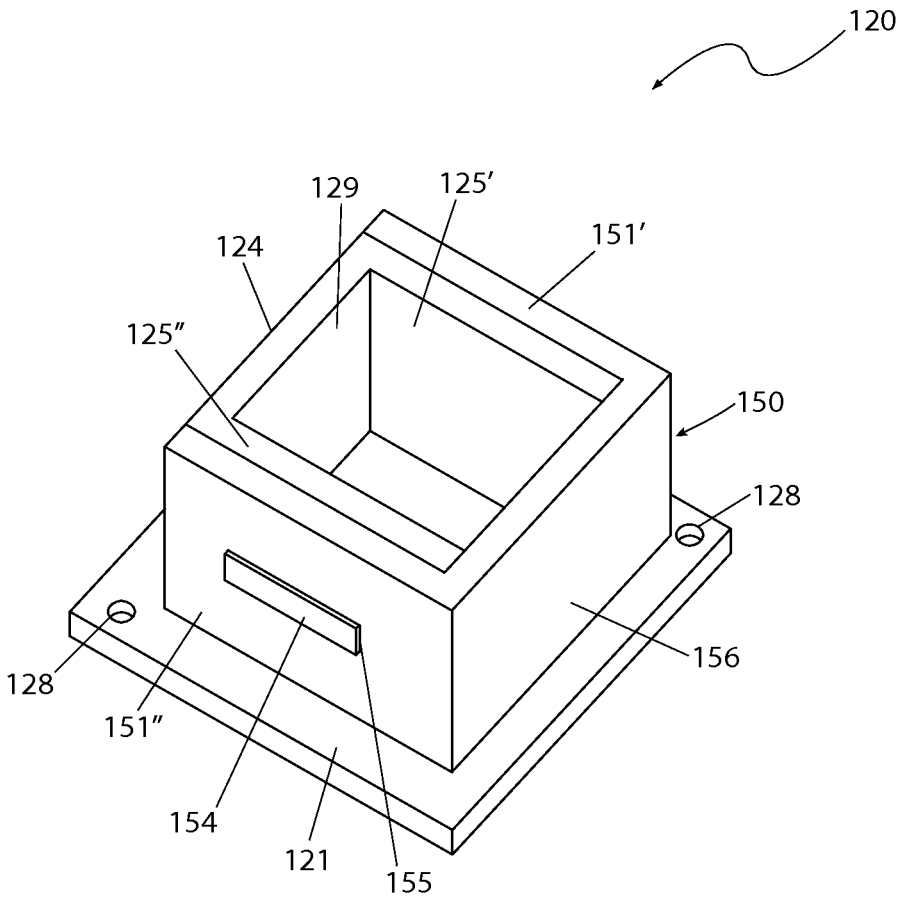
FIG. 8 is a side perspective view of a mounting bracket of the baluster bracket assembly of FIG. 6.
Figure 9:
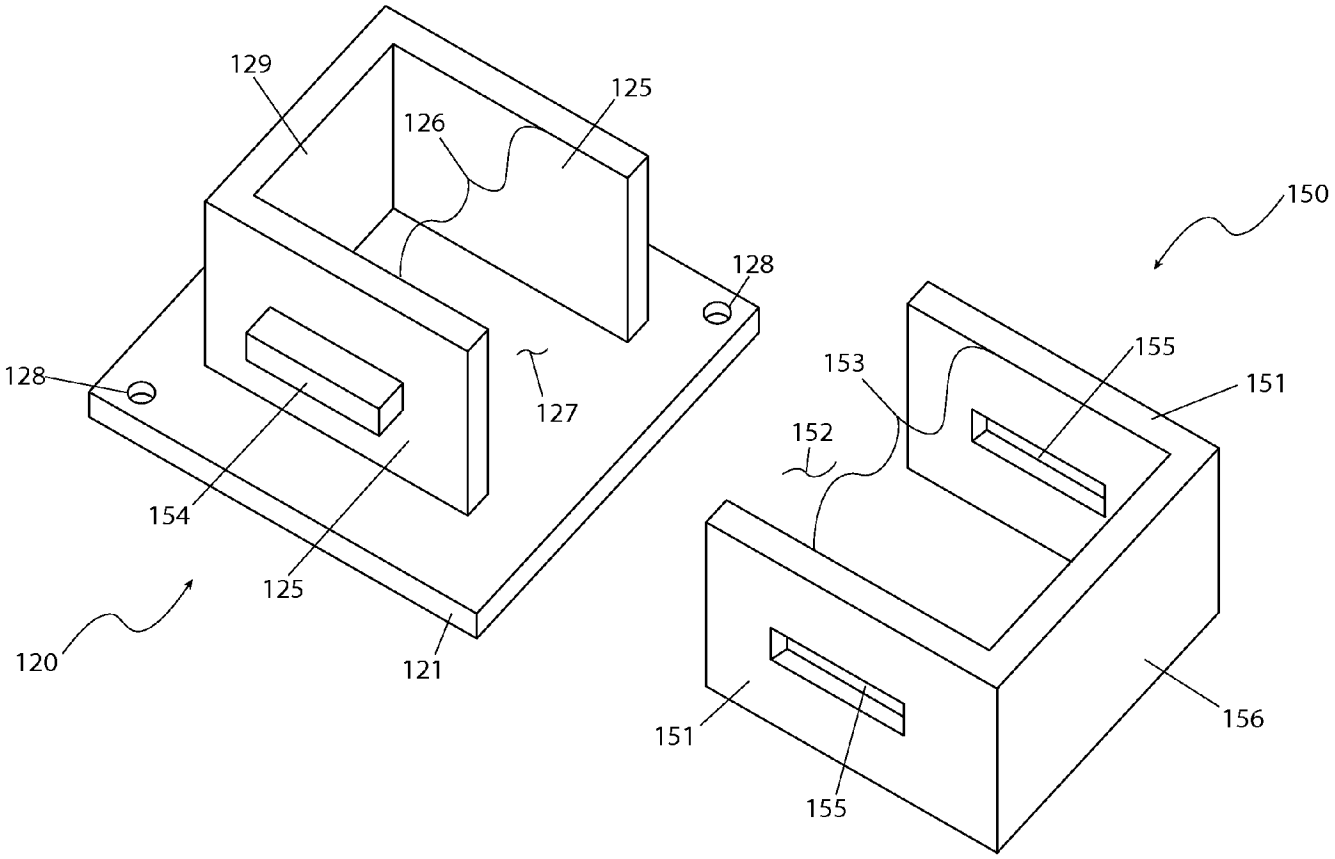
FIG. 9 is an exploded side perspective view of the mounting bracket of FIG. 8.

The mounting bracket 120 can include a removably attachable clip 150 which covers over the open side 127 to retain the baluster 14 within the collar 124 and provides an additional physical bather to prevent the baluster 14 from disengaging from within the collar 124 once inserted. The clip 150 can include side walls 151 and an open side 152 forming a generally "U"-shaped or "C"-shaped member defining an open interior 153 which matches the exterior profile shape of the collar 124. For example, the clip 152 can include three (3) generally perpendicular side walls 151 and the open side 152 forming a generally square cross-sectional shape having an interior area 153. The clip 150 can be suitably dimensioned such that the distance between interior surfaces of the side walls 151 (i.e., the interior area 153) is in close tolerance with the external dimensions of laterally opposed side walls 125', 125" of the collar 124 to provide for a secure friction fit. For example, the interior area 153 of the clip 150 can have substantially the same configuration and size as the exterior surface of the collar 124 and sufficient to receive two (2) laterally opposed side walls 125' and 125" of the collar 124 (FIGS. 6 through 8).

The collar 124 can include at least one (1) pair of external protrusions 154, at least one protrusion 154 extending outwardly from an exterior surface of each laterally opposed side wall 125', 125". The protrusions 154 can be elongated extending generally between, but not to, the side edges of the side walls 125', 125". For example, as illustrated in FIGS. 6 and 7, the protrusions 154 can be aligned and parallel with one (1) another and generally parallel to the mounting plate 121 (i.e., generally horizontal when the mounting bracket 120 is attached to the support rails 15, 16). In another example (not shown), the protrusions 154 can be aligned and parallel with one (1) another and generally perpendicular to the mounting plate 121 (i.e., generally vertical when the mounting bracket 120 is attached to the support rails 15, 16).

The clip 150 can include at least one pair of slots 155, at least one slot 155 disposed through each laterally opposed side wall 151', 151". The slots 155 can be elongated extending generally between, but not to, the side edges of the side walls 151', 151". For example, as illustrated in FIGS. 6 and 7, the slots 155 can be aligned and parallel with one (1) another (generally horizontal when the clip 150 is attached to the collar 124). In another example (not shown), the slots 155 can be aligned and parallel with one (1) another (generally horizontal when the clip 150 is attached to the collar 124). The slots 155 can be suitably dimensioned to insertably receive the protrusions 154 when the clip 150 is engaged over and connected to the collar 124.

The clip 150 can be semi-rigid having sufficient flexibility to flex about the rear side wall 156 such that the lateral side walls 151', 151" expand outwardly to clear the protrusions 154 when being applied to or removed from the collar 124. Once the clip 150 is applied to the collar 124, the protrusions 154 insertably mate within the slots 155 and the interior surfaces of side walls 151', 151" of the clip 150 contact the exterior surfaces of the side walls 125', 125" of the collar 124 in order to retain the clip 150 on the collar 124 and around the ends 17, 18 of the baluster 14. In order to remove the clip 150, the side walls 151', 151" of the clip 150 are flexed outwardly and pulled away from the side walls 125', 125" of the collar 124 and the slots 155 are disengaged from the protrusions 154.

Referring next to FIGS. 11 through 14, another embodiment of the disclosed assembly 10 can include a mounting bracket 220 configured to receive an upper end 17 or lower end 18 of the baluster 14 and to support the baluster 14 between the opposing support rails 15, 16 and a covering shoe 230 slidably connected to the ends 17, 18 of the baluster 14 to cover the mounting bracket 220. During construction of the railing system, a first (i.e., upper) mounting bracket 220 can be fastened to the bottom surface of the handrail 15 and a second (i.e., lower) mounting bracket 220 can be fastened to the opposing top surface of the baserail 16 for joining each baluster 14.

Figure 11:
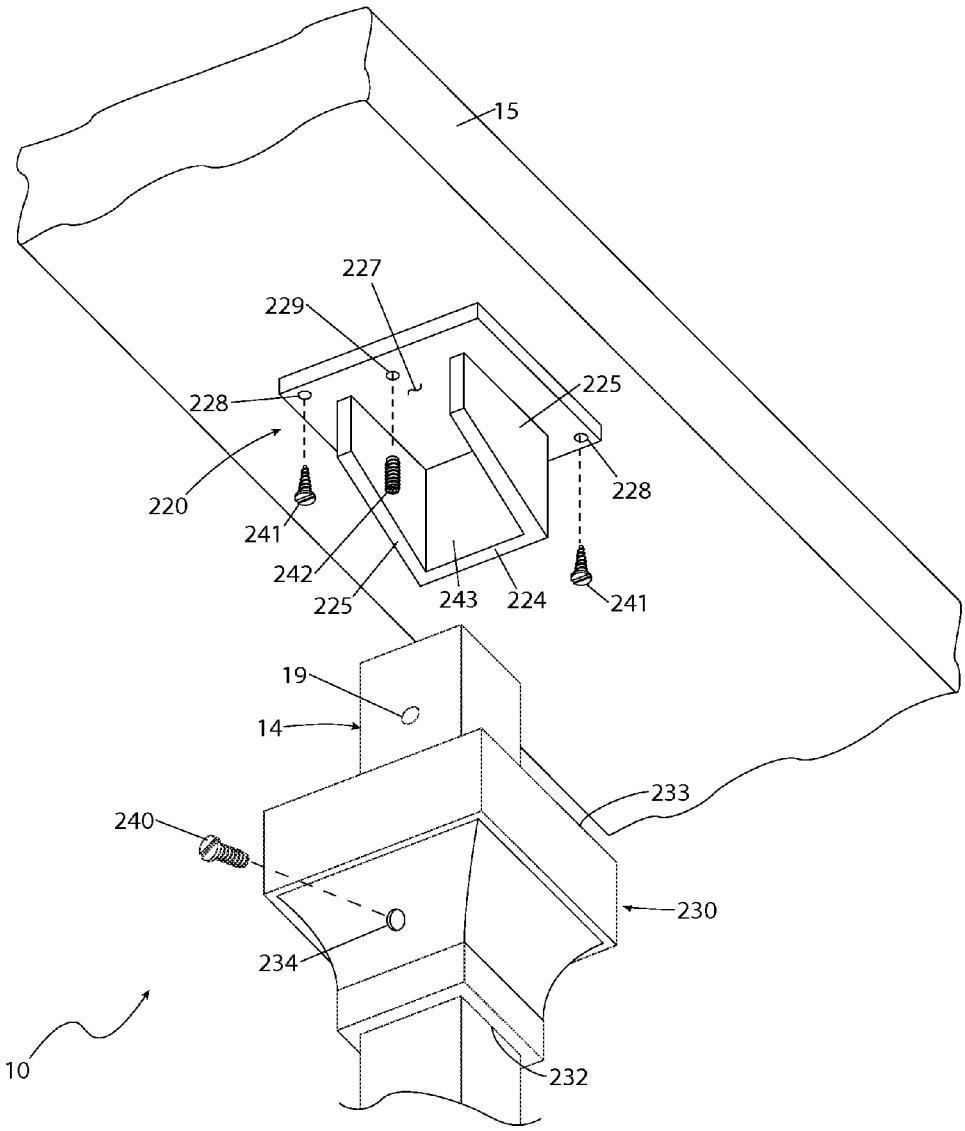
FIG. 11 is an exploded front perspective view of another embodiment of the baluster bracket assembly.
Figure 12:
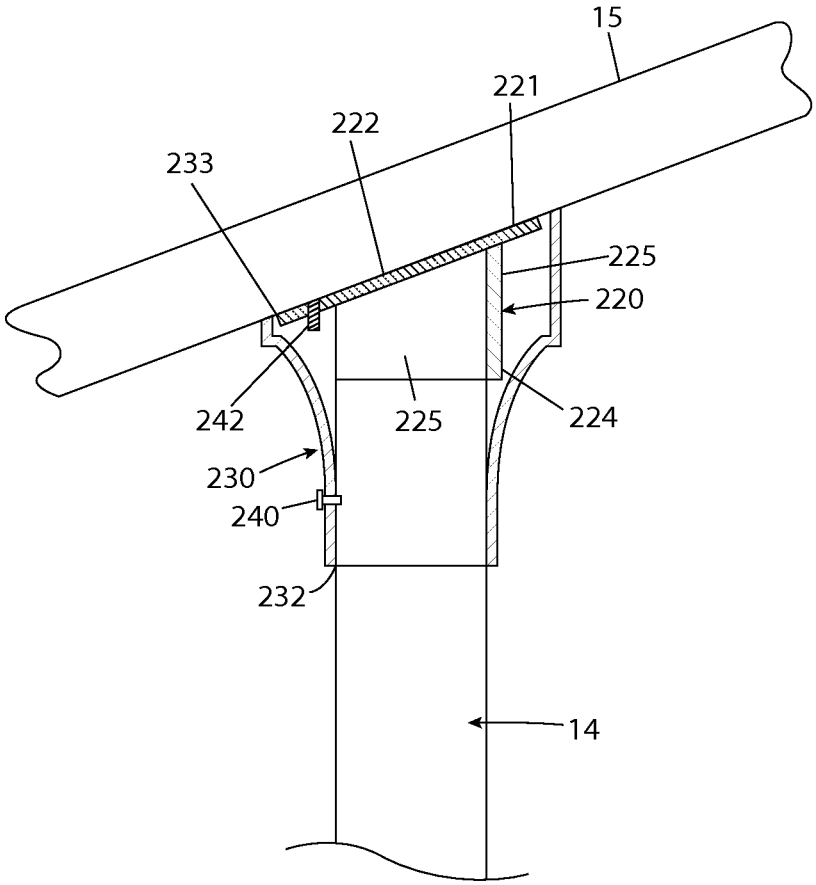
FIG. 12 is a transparent side view of the baluster bracket assembly of FIG. 11 depicted in an assembled state.
Figure 13:
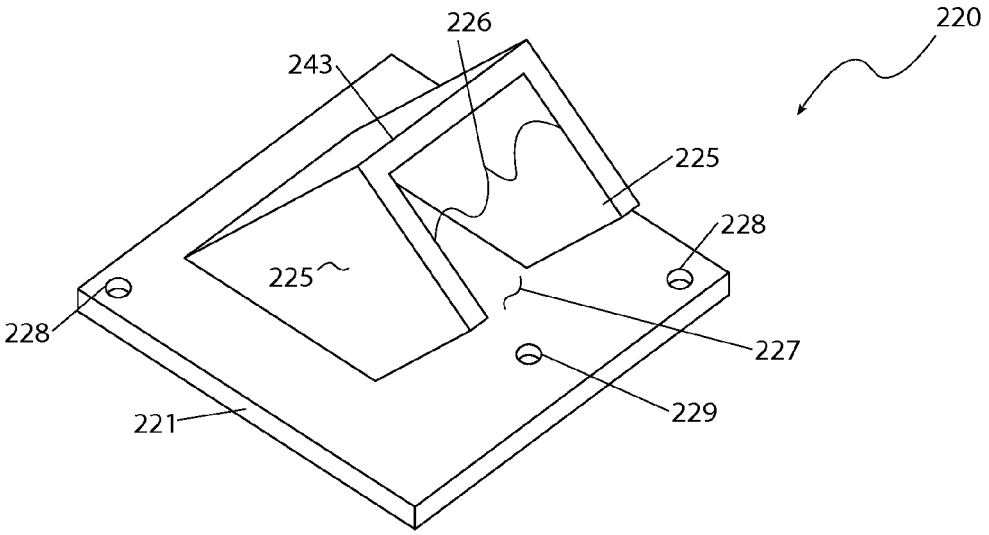
FIG. 13 is a side perspective view of a mounting bracket of the baluster bracket assembly of FIG. 11.

At this point, it can be appreciated by one skilled in the art that the railing system typically includes a plurality of spaced apart balusters 14 and each baluster 14 would utilize a pair of mounting brackets 220 and a pair of shoes 230 and that only a single baluster 14 and a single mounting bracket 220 and shoe 230 are disclosed in any given illustrated embodiment since each assembly 10 can be identical with the others. It can also be appreciated by one skilled in the art that the configurations illustrated in FIGS. 11 and 12 are of the upper mounting bracket 220 and a sloped handrail 15, and that the configuration of the lower mounting bracket 220 used with a sloped baserail 16 (not shown) can be an inverted and substantially identical implementation of the assembly 10.

Referring still to FIGS. 11 through 14, the mounting bracket 220 can include a generally flat mounting plate 221 having an exterior rail mounting surface 222 and an interior baluster mounting surface 223. A collar 224 can extend outwardly from the baluster mounting surface 223 at a generally central location. The collar 224 can include side walls 225 defining and interior area 226 for insertably receiving an end 17, 18 of the baluster 14. For example, the collar 224 can include two (2) generally perpendicular lateral side walls 225, an angled rear wall 243, and an open side 227 forming a generally square cross-sectional shape. The open side 227 can be configured to slidably receive the end 17, 18 of the baluster 14 within the interior area 226. The open side 227 of the collar 224 allows the ends 17, 18 of the baluster 14 to slide in to and out from the mounting bracket 220 when joining of the baluster 14.

In another example (not shown), the collar 24 can include two generally perpendicular side walls 225 and two angled side walls 243 (i.e., front and rear walls) to insertably receive the end 17, 18 of the baluster 14 within the interior area 226. The side walls 225 of the collar 224 can be perpendicular to the mounting plate 221. The rear wall 243 can be sloped at and angle relative to the mounting plate 221. The side edges of the side walls 225 can have an angled slope equivalent to the angle of the rear wall 243, such that the collar 224 generally extends at an angle relative to the mounting plate 221.

Figure 24:
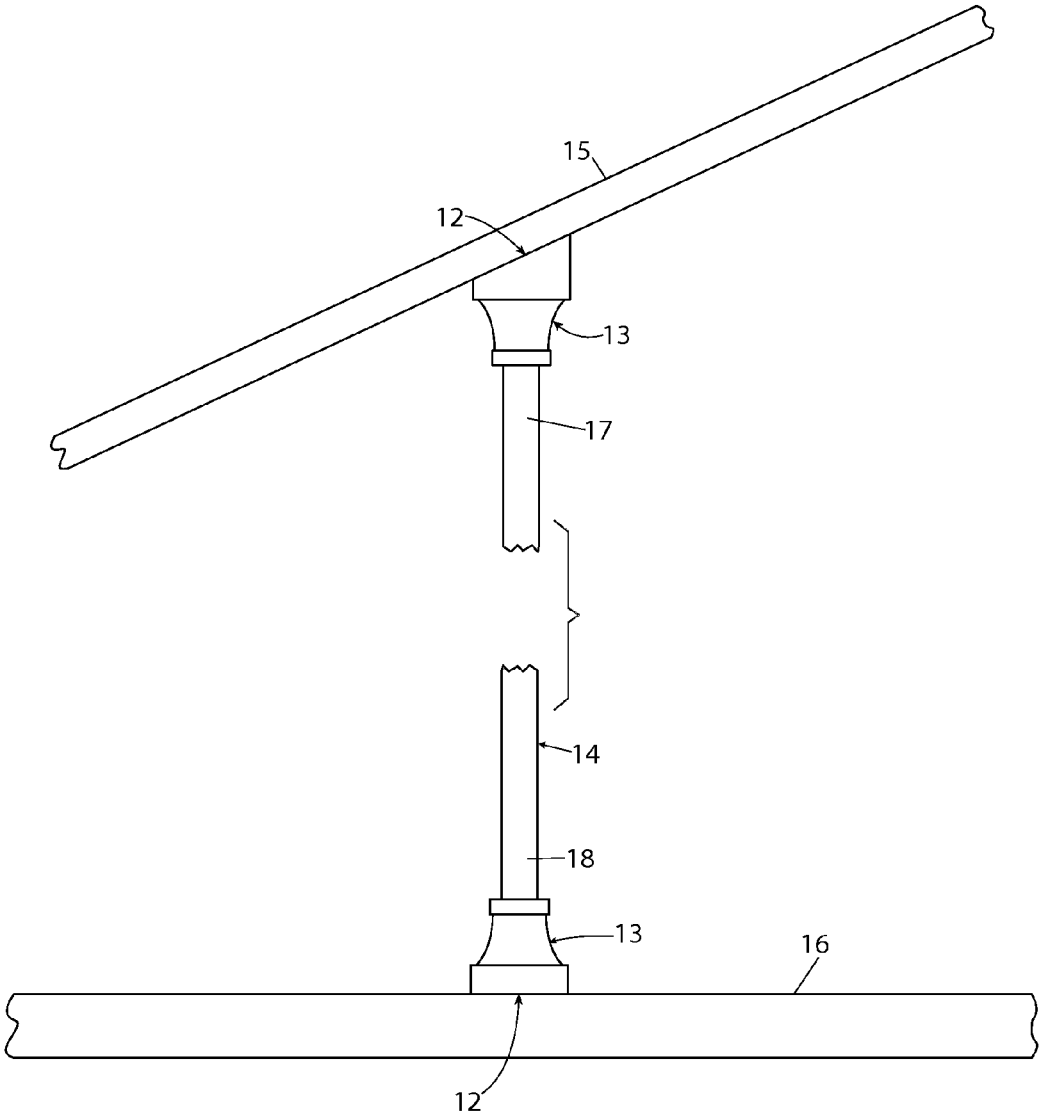
FIG. 24 is a fragmented side view of another implementation of the baluster bracket assembly depicted in use on a sloped handrail and a horizontal baserail; and, FIG. 25 is a fragmented side view of another implementation of the baluster bracket assembly depicted in use on a sloped handrail and a sloped baserail.
Figure 25:
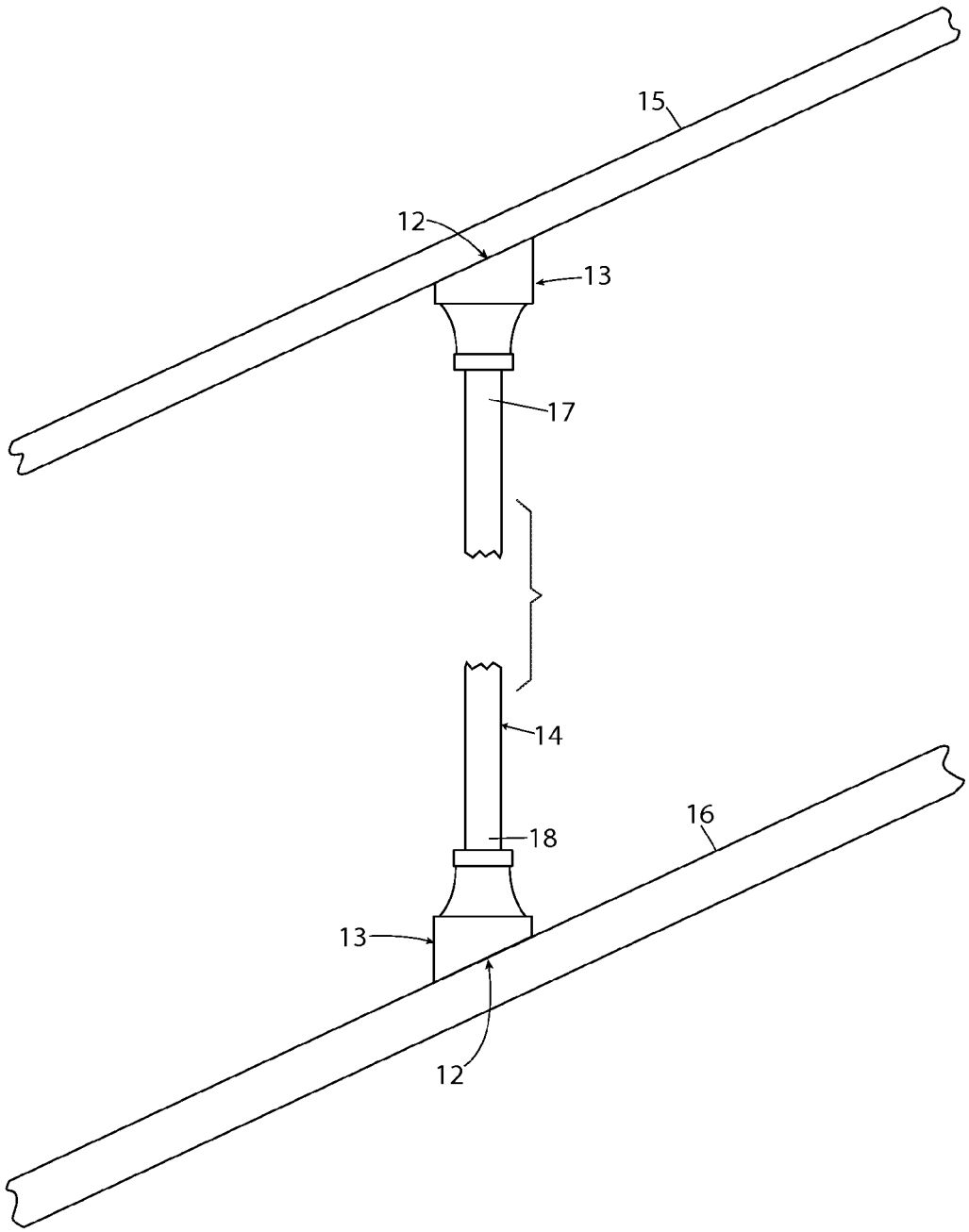

For example, the angle of this sloped collar 224 can be approximately thirty-one degrees (31°). The orientation of this sloped collar 224 can allow for attachment of the balusters 14 in a generally vertical orientation between a sloped handrail 15 and a sloped baserail 16, as shown in FIG. 25. As shown in FIG. 24, a combination of a perpendicular mounting bracket 20, 120 having a perpendicular collar bracket 24, 224 and a sloped mounting bracket 220 having a sloped collar bracket 224 can be used for attaching vertical balusters 14 between a sloped handrail 15 and a horizontal baserail 16.

The collar 224 can be suitably dimensioned such that the distance between interior surfaces of the side walls 225 (i.e., the interior area 226) is in close tolerance with the external dimensions of the ends 17, 18 of the baluster 14 to provide for a secure friction fit. For example, the interior area 226 of the collar 224 can have substantially the same configuration and size as the exterior surface of the ends 17, 18 of the baluster 14 and is sufficient to receive three sides of the baluster 14 (FIGS. 11 and 12). In the depicted embodiment, the collar 224 and interior area 226 can have a square shape, as most typical balusters 14 have an upper end 17 and a lower end 18 having a square cross-sectional shape. However, it can be appreciated by one skilled in the art that the sidewalls 225 of the collar 224 and interior area 226 can be formed having various sizes and geometric shapes depending on the particular style of baluster 14 being used.

The shoe 230 can include a decorative exterior and a hollow internal through channel 231 extending entirely along a longitudinal axis from a top end 232 of the shoe 230 to a bottom end 233 of the shoe 230. The exterior shape and design of the shoe 230 can vary greatly and as such the illustrated embodiment should not be viewed as a limiting factor of the present disclosure. The open top end 232 and open bottom end 233 provide insertable access to the channel 231 by the ends 17, 18 of the baluster 14, such that the shoe 230 is slidable along the length of the baluster 14. The top end 232 can be suitably sized and shaped to receive the end 17, 18 of the baluster 14, which can pass entirely through the channel 231 and extend out from the bottom end 233. The bottom end 233 can be suitably sized and shaped to receive and cover the mounting plate 221 and the collar 224. The bottom end 233 of the shoe 230 can include an angled bottom surface to adequately receive the sloped mounting bracket 220 and sloped collar 224 around the mounting plate 221 and to contact the sloped support rail 15, 16 when applied to the generally vertical baluster 14.

Figure 14:
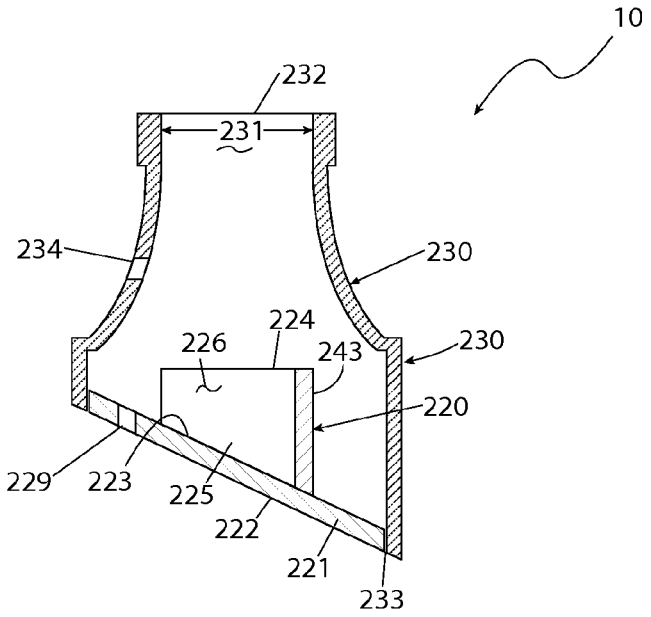
FIG. 14 is a side elevation view, in section, of the baluster bracket assembly of FIG. 11.

The shoe 230 retains the respective ends 17, 18 of the baluster 14 within the collar 224 once positioned over and covering the mounting bracket 220. The shoe 230 can include a fastening aperture 234 disposed through a sidewall of the shoe 230. The aperture 234 can threadably receive a threaded fastener 240; the fastener 240 can extend through the sidewall of the shoe 230 and threadingly fasten to another fastening aperture 19 disposed in a side of the end 17, 18 of the baluster 14 when the apertures 19, 234 are aligned. As best seen in FIGS. 11 and 14, the sloped shoe 230 can include an angled bottom end 233 and can be used with the angled mounting bracket 220 having the angled collar 224.

The mounting bracket 220 can include a plurality of fastening apertures 228 formed through opposing corners of the mounting plate 221. The apertures 228 can receive threaded fasteners 241 which extend through the mounting plate 221 and are screwed into the bottom (i.e., underside) surface of the handrail 15 or the top surface of the baserail 16 to secure the respective mounting brackets 220. The mounting brackets 220 can be fastened to the respective rails 15, 16 to securely join the balusters 14 between the rails 15, 16. The collars 224 can prevent lateral and rotational movement the balusters 14. The mounting bracket 220 can include at least one set screw aperture 229 formed through the mounting plate 221 adjacent to the open side 227 of the collar 224. The aperture 229 can receive a threaded set screw 242 which at least partially protrudes from the mounting plate 221 and provides an additional physical bather to prevent the baluster 14 from disengaging from within the collar 224 once inserted.

It can be appreciated that the rail mounting surface 223 of the mounting bracket 220 can be fastened to the support rails 15, 16 by other suitable fastening means, such as adhesives or other mechanical fastening hardware and the illustrated fasteners are not meant to limit the scope of the present disclosure. It can also be appreciated that the support rails 15, 16 can be provided with integral mounting brackets 220 longitudinally spaced apart along the respective top and bottom surfaces. The integral mounting brackets 220 can be integrally molded or affixed by any suitable manufacturing technique, such as welding, sonic welding, industrial adhesives, or the like.

Figure 15:
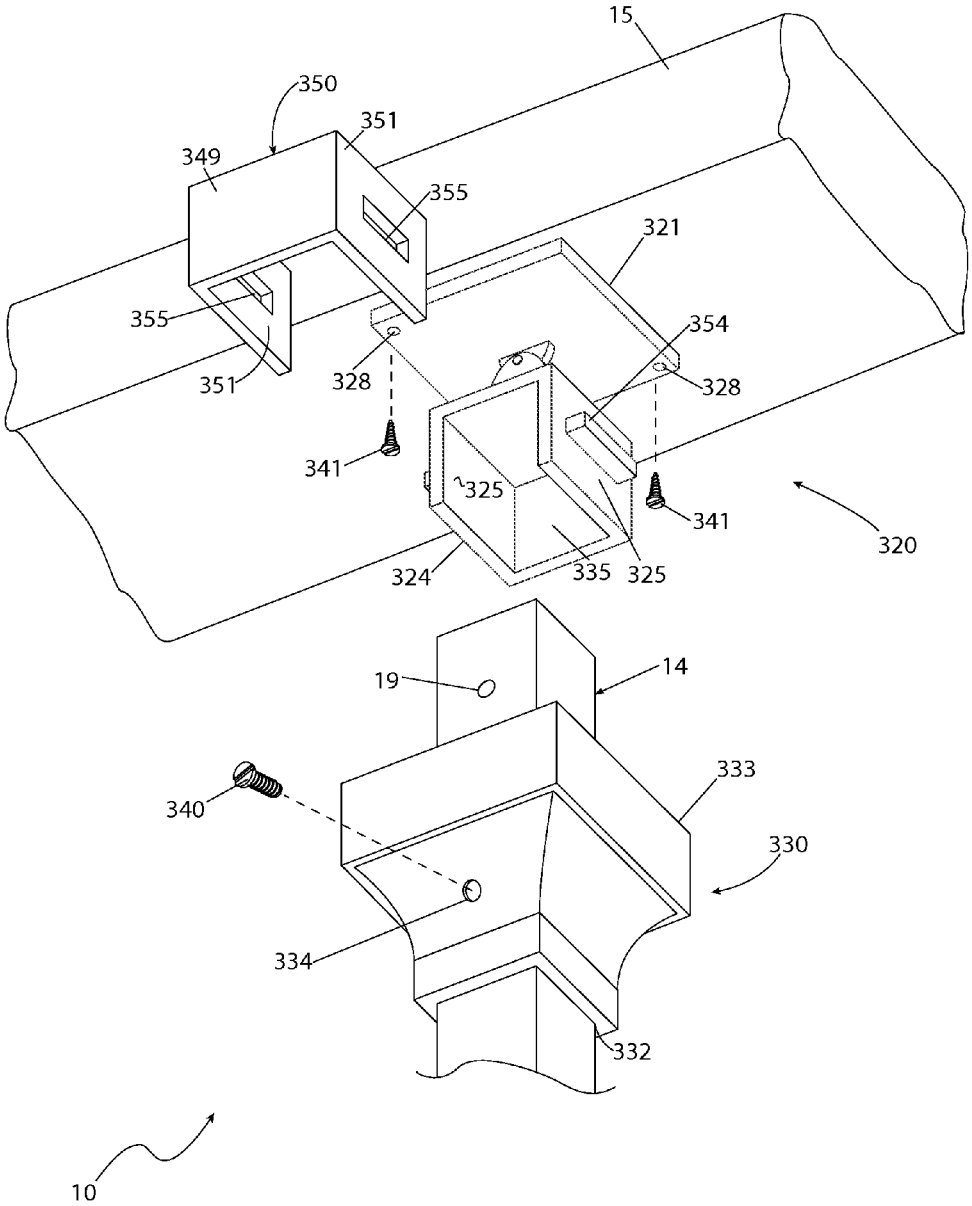
FIG. 15 is an exploded front perspective view of another embodiment of the baluster bracket assembly.
Figure 16:
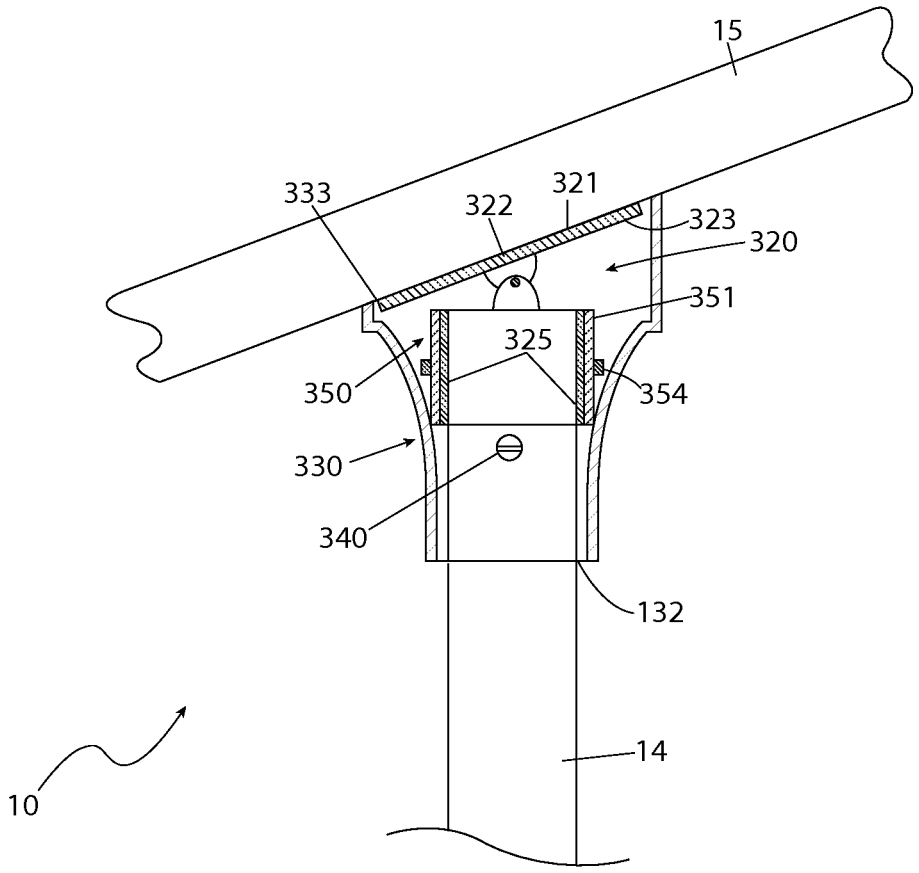
FIG. 16 is a transparent front view of the baluster bracket assembly of FIG. 15.

Referring next to FIGS. 15 through 22, another embodiment of the disclosed assembly 10 can include an adjustable mounting bracket 320 configured to receive an upper end 17 or lower end 18 of the baluster 14 and to support the baluster 14 between the opposing support rails 15, 16 and a covering shoe 330 slidably connected to the ends 17, 18 of the baluster 14 to cover the mounting bracket 320. During construction of the railing system, a first (i.e., upper) mounting bracket 320 can be fastened to the bottom surface of the handrail 15 and a second (i.e., lower) mounting bracket 320 can be fastened to the opposing top surface of the baserail 16 for joining each baluster 14. At this point, it can be appreciated by one skilled in the art that the configurations illustrated in FIGS. 15 and 16 are of the upper mounting bracket 320 and a sloped handrail 15, and that the configuration of the lower mounting bracket 320 used with a sloped baserail 16 (not shown) can be an inverted and substantially identical implementation of the assembly 10.

The mounting bracket 320 can include a generally flat mounting plate 321 having an exterior rail mounting surface 322 and an interior baluster mounting surface 323. A collar 324 can be pivotably connected to and extend outwardly from the baluster mounting surface 323 at a generally central location. The collar 324 can include a rear side wall 335, laterally opposed side walls 325, and a bottom wall 362 defining and interior area 326 for insertably receiving an end 17, 18 of the baluster 14. For example, the collar 324 can include three generally perpendicular side walls 325, a bottom wall 362, and an open side 327 forming a generally square cross-sectional shape. The open side 327 can be configured to slidably receive the end 17, 18 of the baluster 14 within the interior area 126. The open side 327 of the collar 324 allows the ends 17, 18 of the baluster 14 to slide in to and out from the mounting bracket 120 when joining of the baluster 14. In another example (FIG. 22), the collar 324 can include four generally perpendicular side walls 325 and a bottom wall 362 to insertably receive the end 17, 18 of the baluster 14 within the interior area 326.

The collar 324 can be suitably dimensioned such that the distance between interior surfaces of the side walls 335, 325 (i.e., the interior area 326) is in close tolerance with the external dimensions of the ends 17, 18 of the baluster 14 to provide for a secure friction fit. For example, the interior area 326 of the collar 324 can have substantially the same configuration and size as the exterior surface of the ends 17, 18 of the baluster 14 and is sufficient to receive three sides of the baluster 14 (FIGS. 15 and 16). In the depicted embodiment, the collar 324 and interior area 326 can have a square shape, as most typical balusters 14 have an upper end 17 and a lower end 18 having a square cross-sectional shape. However, it can be appreciated by one skilled in the art that the sidewalls 325 of the collar 324 and interior area 326 can be formed having various sizes and geometric shapes depending on the particular style of baluster 14 being used.

The mounting plate 321 can include a mounting member 356 that pivotably supports a support member 357 of the collar 324. The mounting member 356 can extend perpendicularly from the mounting plate 321 at a generally central location. The mounting member 356 can have any suitable profile shape and is illustrated here, by example, as having a semi-circular shape with an arcuate top surface. The mounting member 356 can include an aperture 358 therethrough, proximate a top end. In one (1) embodiment, the support member 357 can include a pair of laterally spaced apart side plates 359 that extend perpendicularly from a underside surface of the collar 324. Each side plate 359 can have a top end affixed to the exterior surface of the bottom wall 362 of the collar 324 and a bottom end. A pivot aperture 360 extends through the bottom end of each side plate 359.

Figure 19:
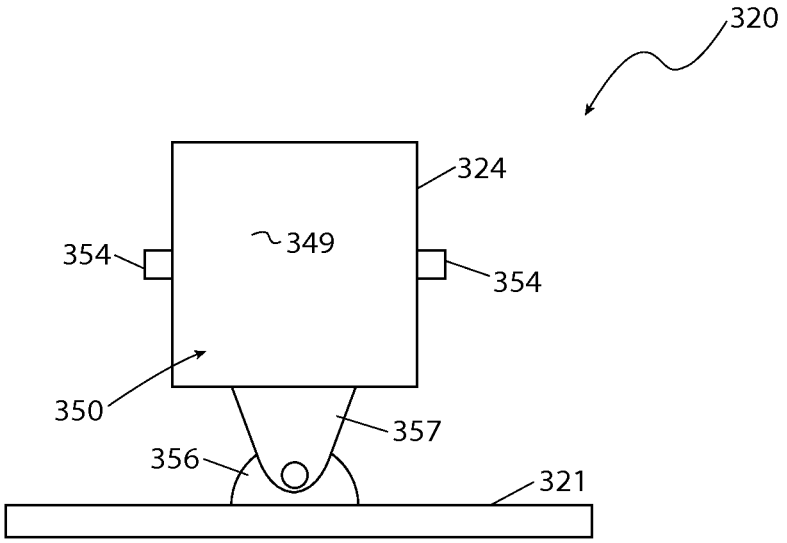
FIG. 19 is a front elevation view of the mounting bracket of FIG. 17.
Figure 20:
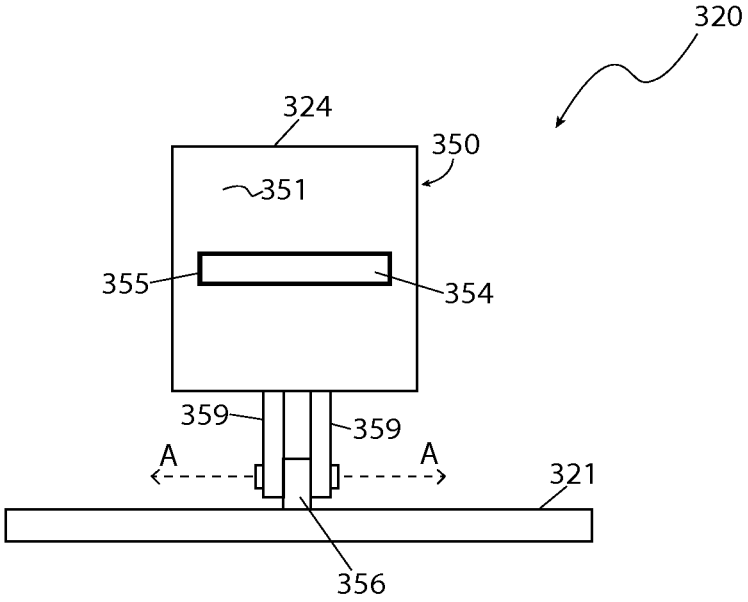
FIG. 20 is a side elevation view of the mounting bracket of FIG. 17.

When assembled, as shown in FIGS. 19 and 20, the mounting member 356 is positioned between the side plates 359 of the support member 357 such that the pivot apertures 360 are coaxially aligned with the aperture 358 along a pivot axis "A-A". The support member 357 is pivotally supported on the mounting member 356 by a pivot member 361. The pivot member 361 can be any suitable cylindrical fastener, such as a pin, bolt and nut, or the like, that extends through the aperture 360 in a first side plate 359 of the support member 357, through the aperture 358 in the mounting member 356, and through the aperture 360 in a second side plate 359 of the support member 357.

The adjustable mounting bracket 320 allows for the collar 324 to be positioned at a variety of angles relative to the mounting plate 321. For example, the angle of this adjustable collar 324 can be positioned between approximately thirty-one degrees (31°) and forty-one degrees (41°) depending upon the slope of the support rail 15, 16. The adjustability of this pivotable collar 324 can allow for attachment of the balusters 14 in a generally vertical orientation between a sloped handrail 15 and a sloped baserail 16, as shown in FIG. 25. As shown in FIG. 24, a combination of a perpendicular mounting bracket 20, 120 having a perpendicular collar bracket 24, 224 and an adjustable mounting bracket 320 having a pivotable collar bracket 324 can be used for attaching vertical balusters 14 between a sloped handrail 15 and a horizontal baserail 16.

The shoe 330 can include a decorative exterior and a hollow internal through channel 331 extending entirely along a longitudinal axis from a top end 332 of the shoe 330 to a bottom end 333 of the shoe 330. The exterior shape and design of the shoe 330 can vary greatly and as such the illustrated embodiment should not be viewed as a limiting factor of the present disclosure. The open top end 332 and open bottom end 333 provide insertable access to the channel 331 by the ends 17, 18 of the baluster 14, such that the shoe 330 is slidable along the length of the baluster 14. The top end 332 can be suitably sized and shaped to receive the ends 17, 18 of the baluster 14, which can pass entirely through the channel 331 and extend out from the bottom end 333. The bottom end 333 can be suitably sized and shaped to receive and cover the mounting plate 321 and the collar 324. The bottom end 333 of the shoe 330 can include an angled bottom surface to adequately receive the adjustable mounting bracket 320 and pivotable collar 324 around the mounting plate 321 and to contact the sloped support rail 15, 16 when applied to the generally vertical baluster 14. The angle of the bottom surface of the bottom end 333 of the shoe 330 can be approximately between thirty-seven degrees (37°) and forty-one degrees (41°) depending upon the slope of the support rail 15, 16.

Figure 21:
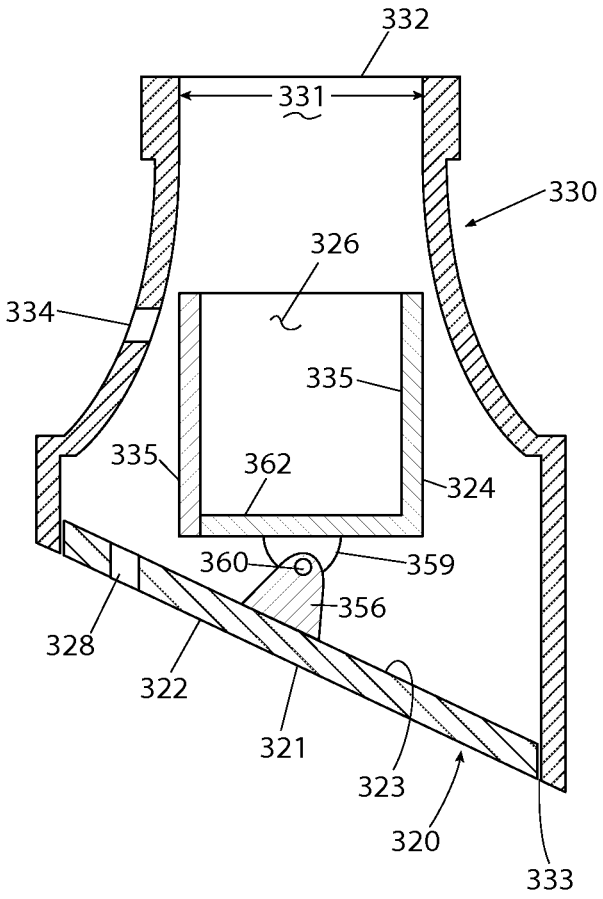
FIG. 21 is a side elevation view, in section, of the baluster bracket assembly of FIG. 15.
Figure 22:
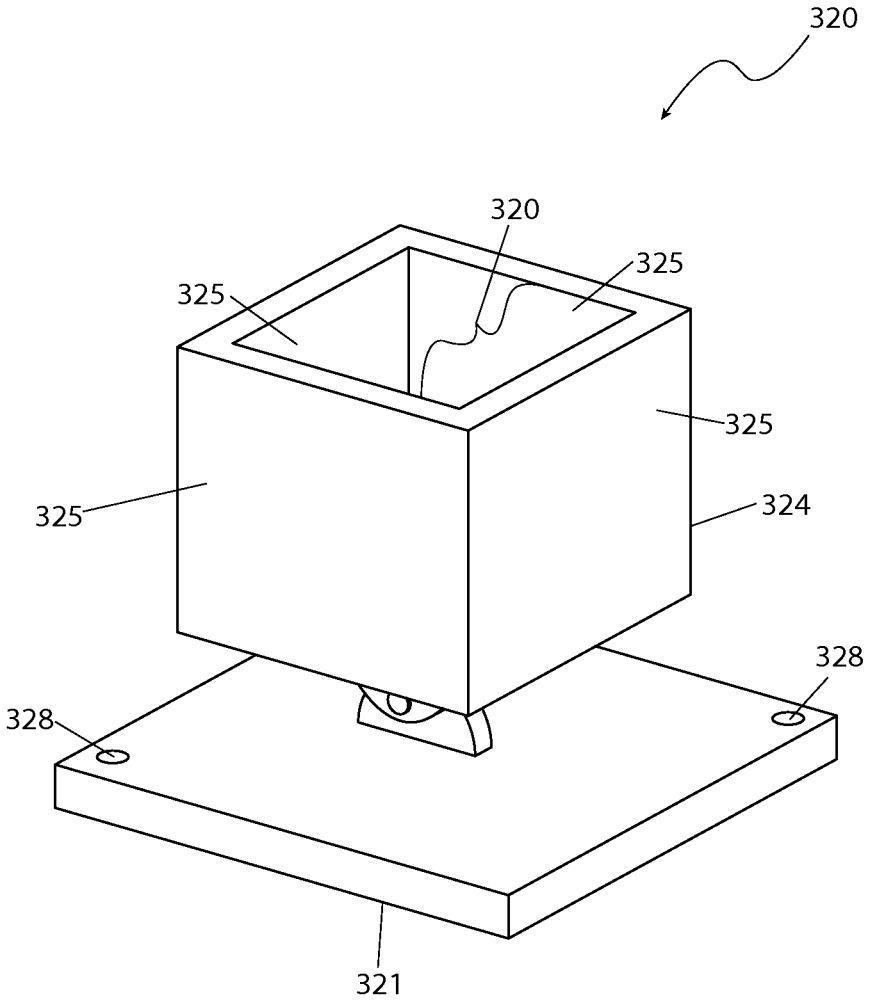
FIG. 22 is a side perspective view of another embodiment of a mounting bracket of the baluster bracket assembly of FIG. 15.

The shoe 330 retains the respective ends 17, 18 of the baluster 14 within the collar 324 once positioned over and covering the mounting bracket 320. The shoe 330 can include a fastening aperture 334 disposed through a sidewall of the shoe 330. The aperture 334 can threadably receive a threaded fastener 340; the fastener 340 can extend through the sidewall of the shoe 330 and threadingly fasten to another fastening aperture 19 disposed in a side of the end 17, 18 of the baluster 14 when the apertures 19, 334 are aligned. As best seen in FIGS. 15, 16, and 21, the sloped shoe 330 can include an angled bottom end 333 and can be used with the adjustable mounting bracket 320 having the pivotable collar 324.

The mounting bracket 320 can include a plurality of fastening apertures 328 formed through opposing corners of the mounting plate 321. The apertures 328 can receive threaded fasteners 341 which extend through the mounting plate 321 and are screwed into the bottom surface of the handrail 15 or the top surface of the baserail 16 to secure the respective mounting brackets 320. The mounting brackets 320 can be fastened to the respective rails 15, 16 to securely join the balusters 14 between the rails 15, 16. The collars 324 can prevent lateral and rotational movement the balusters 14.

The mounting bracket 320 can include a removably attachable clip 350 which covers over the open side 327 to retain the baluster 14 within the collar 324 and provides an additional physical bather to prevent the baluster 14 from disengaging from within the collar 324 once inserted. The clip 350 can include side walls 351 and an open side 352 forming a generally "U"-shaped or "C"-shaped member defining an open interior 353 which matches the exterior profile shape of the collar 324. For example, the clip 352 can include three (3) generally perpendicular side walls 351 and the open side 352 forming a generally square cross-sectional shape having an interior area 353. The clip 350 can be suitably dimensioned such that the distance between interior surfaces of the side walls 351 (i.e., the interior area 3153) is in close tolerance with the external dimensions of laterally opposed side walls 325', 325" of the collar 324 to provide for a secure friction fit. For example, the interior area 353 of the clip 150 can have substantially the same configuration and size as the exterior surface of the collar 324 and sufficient to receive two (2) laterally opposed side walls 325' and 325" of the collar 324 (FIGS. 15 through 21).

Figure 17:
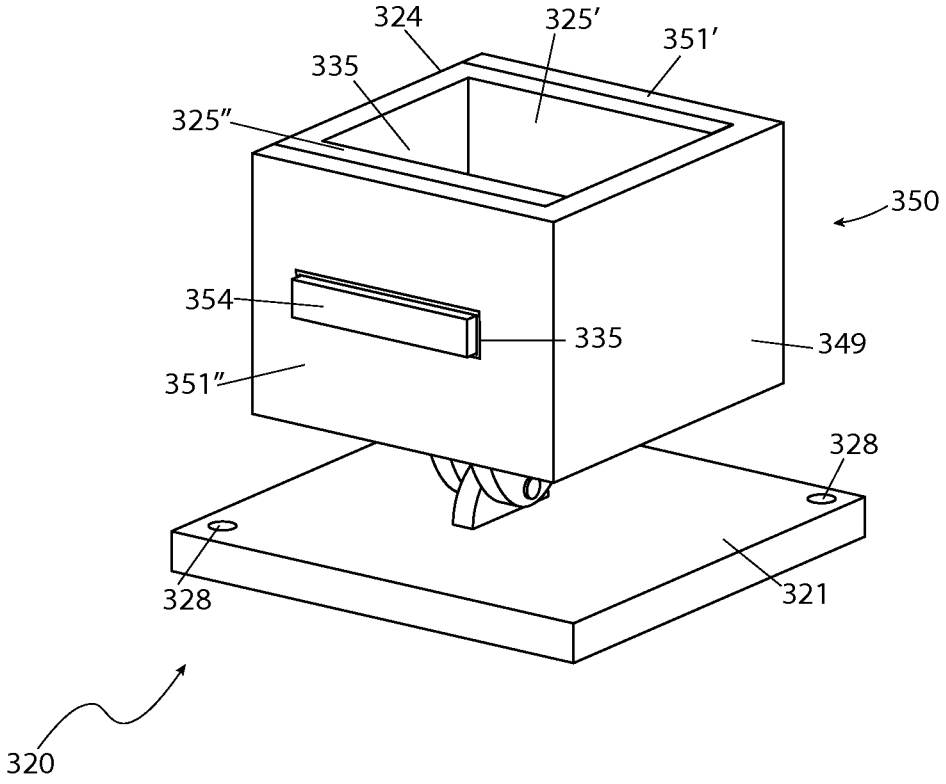
FIG. 17 is a side perspective view of a mounting bracket of the baluster bracket assembly of FIG. 15.
Figure 18:
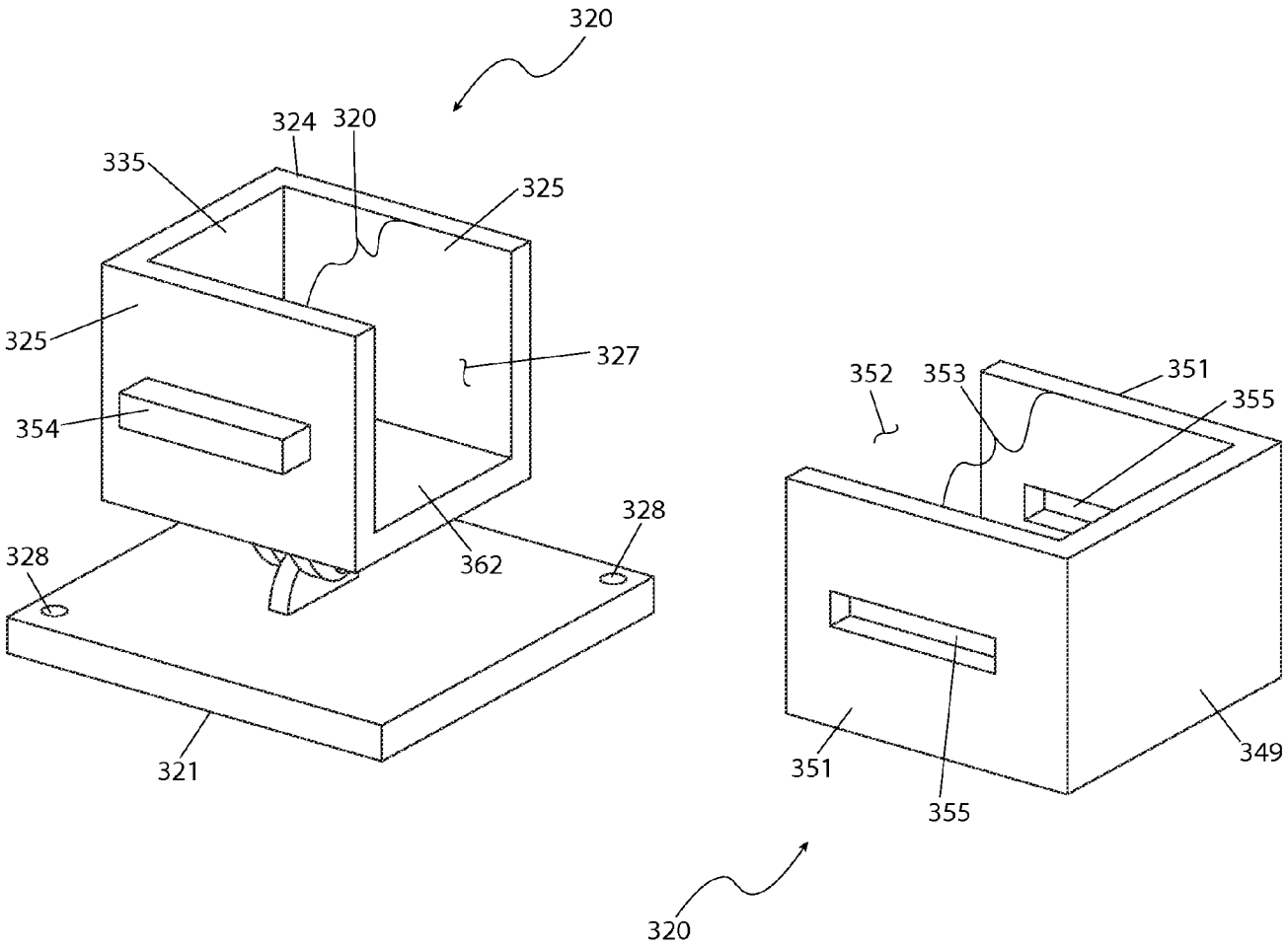
FIG. 18 is an exploded side perspective view of the mounting bracket of FIG. 17.

The collar 324 can include at least one pair of external protrusions 354, at least one protrusion 354 extending outwardly from an exterior surface of each laterally opposed side wall 325', 325". The protrusions 354 can be elongated extending generally between, but not to, the side edges of the side walls 325. For example, as illustrated in FIGS. 15, 17, and 18, the protrusions 354 can be aligned and parallel with one (1) another and generally parallel to the bottom wall of the collar 324. In another example (not shown), the protrusions 354 can be aligned and parallel with one (1) another and generally perpendicular to the bottom wall of the collar 324.

The clip 350 can include at least one pair of slots 355, at least one slot 355 disposed through each laterally opposed side wall 351', 351". The slots 355 can be elongated extending generally between, but not to, the side edges of the side walls 351. For example, as illustrated in FIGS. 17 and 18, the slots 355 can be aligned and parallel with one (1) another (generally parallel with the bottom wall 362 of the collar 324 when attached to the collar 324). In another example (not shown), the slots 355 can be aligned and parallel with one (1) another (generally perpendicular to the bottom wall 362 of the collar 324 when the clip 350 is attached to the collar 324). The slots 355 can be suitably dimensioned to insertably receive the protrusions 354 when the clip 350 is engaged over and connected to the collar 324.

The clip 350 can be semi-rigid having sufficient flexibility to flex about the rear side wall 349 such that the lateral side walls 351', 351" expand outwardly to clear the protrusions 354 when being applied to or removed from the collar 324. Once the clip 350 is applied to the collar 324, the protrusions 354 insertably mate within the slots 355 and the interior surfaces of side walls 351', 351" of the clip 350 contact the exterior surfaces of the side walls 325', 325" of the collar 324 in order to retain the clip 350 on the collar 324 and around the ends 17, 18 of the baluster 14. In order to remove the clip 350, the side walls 351', 351" of the clip 350 are flexed outwardly and pulled away from the side walls 325', 325" of the collar 324 and the slots 355 are disengaged from the protrusions 354.

Referring to FIGS. 23 through 25, the assembly 10 can be used in stair and handrail construction of various styles, including horizontal and sloped mounting surfaces 15, 16. During construction of stairs, the newel post and handrail 15 are attached to a main support structure. A first plurality of mounting brackets 12, chosen from perpendicular mounting brackets 20, 120, angled mounting brackets 220 or adjustable mounting brackets 320, is fastened to the top surface of the baserail 16 in a spaced apart fashion in accordance with the distance between the balusters 14. For horizontal baserails 16, a plurality of mounting brackets 20, 120 having perpendicular collars 24, 124 is used. For sloped baserails 15, a plurality of angled mounting brackets 220 having sloped collars 224 or adjustable brackets 320 having pivotable collars 324 is used. A second plurality of mounting brackets 12, chosen from perpendicular mounting brackets 20, 120, angled mounting brackets 220 or adjustable mounting brackets 320, is fastened to the bottom surface of the handrail 15 in a spaced apart fashion in accordance with the distance between the balusters 14 and aligned with the first plurality of mounting brackets 12. For horizontal handrails 16, a plurality of mounting brackets 20, 120 having perpendicular collars 24, 124 is used. For sloped handrails 15, a plurality of angled mounting brackets 220 having sloped collars 224 or adjustable brackets 320 having pivotable collars 324 is used.

A plurality of balusters 14 are coupled to the opposing pairs of mounting brackets 12 and joined between the handrail 15 and the baserail 16. Each baluster 14 is cut to the correct length required to span the distance between the handrail 15 and the baserail 16. Balusters 14 coupled to perpendicular collars 24, 124 can have perpendicular cuts. Balusters 14 coupled to sloped collars 224 can have angled cuts. Baluster 14 coupled to pivotable collars 324 can have perpendicular cuts.

Once cut to the appropriate length a pair of shoes 13, chosen from flat bottom shoes 30, 130 or angled bottom shoes 230, 330, is slidably connected over each baluster 14. An upper end 17 of the baluster 14 is inserted into the collar 24, 124, 224, 324 of the upper mounting bracket 20, 120, 220, 320 fastened to the handrail 15 and the lower end 18 is inserted into the collar 24, 124, 224, 324 of the lower mounting bracket 20, 120, 220, 320 fastened to the baserail 16. Once inserted, the set screw 42, 242 is partially inserted into the set screw apertures 29, 229 of both mounting brackets 20, 220 to retain the baluster 14 within the collars 24, 224. Each shoe 30, 230 is positioned over the mounting bracket 20, 220 and is fastened to the baluster 14 by aligning the fastening apertures 34, 234 of the shoe 30, 230 with the aperture 19 of the baluster 14 and inserting a fastener 40, 240. Alternatively, once inserted, the clip 150, 350 is attached over the collar 124, 324 of both mounting brackets 120, 320 to retain the baluster 14 within the collars 124, 324. Each shoe 130, 330 is positioned over the mounting bracket 120, 320 and is fastened to the baluster 14 by aligning the fastening apertures 134, 334 of the shoe 130, 330 with the aperture 19 of the baluster 14 and inserting a fastener 140, 340.

Mounting brackets 20, 120 having perpendicular collars 24, 124 are preferably fastened to the handrail 15 and baserail 16, such that the open side 27, 127 of the collar 24, 124 is facing inwardly toward the stairs, landing, or other walking surface for increased safety. Mounting brackets 220 having sloped collars 224 are preferably fastened to the handrail 15 and baserail 16, such that the open side 227 of the collar 224 is facing toward an adjacent baluster 14 for increased safety.

The foregoing embodiments of the disclosed baluster bracket assembly have been presented for purposes of illustration and description. They are not intended to be exhaustive or to limit the invention and method of use to the precise forms disclosed. It can be appreciated by one skilled in the art that other styles, configurations, and modifications of the invention can be incorporated into the teachings of the present disclosure upon reading the specification and that the embodiments of the disclosed baluster bracket assembly shown and described are for the purposes of clarity and disclosure and to limit the scope. The embodiments have been chosen and described in order to best explain the principles and practical application in accordance with the invention to enable those skilled in the art to best utilize the various embodiments with expected modifications as are suited to the particular use contemplated. The present application includes such modifications and is limited only by the scope of the claims.

What is claimed is:

1. A bracket assembly comprising:

a mounting plate configured to attach to a railing support surface;

a collar pivotally attached to said mounting plate, said collar comprising:

a collar bottom wall;

three collar side walls extending perpendicularly from said bottom wall, said three collar side walls comprising a first collar side wall and two laterally opposed collar side walls extending perpendicularly from said first collar side wall, wherein a protrusion is formed on an outer surface of each of said side walls;

a collar open side disposed between said laterally opposed collar side walls opposite said first collar side wall suitably sized to receive an end of a baluster; and, an open collar top opposite said collar bottom wall, wherein said three collar side walls and said collar bottom wall define an interior area comprising a shape corresponding equivalently to a cross-sectional shape of said end of said baluster; and a U-shaped clip comprising a first clip side wall and laterally opposed clip side walls extending from said first clip side wall;

whereby said clip is connected to said collar such that said first clip side wall substantially covers the collar open side and the opposed clip side walls matingly engage with said protrusions on the collar.

2. The bracket assembly of claim 1, wherein:

said collar further comprises a support member comprising an opposed pair of parallel plates extending perpendicularly from said collar bottom wall opposite said collar side walls, said mounting plate comprises a mounting member extending perpendicularly from a center of said mounting plate, said mounting member is received between and pivotally attached to said plates such that said collar pivots with respect to said mounting plate.

3. The bracket assembly of claim 2, further comprising a shoe comprising:

a body comprising an open top end and an open bottom end; and, a hollow channel extending entirely through said body and configured to receive said end of said baluster;

wherein said open bottom end covers said mounting plate and said collar.

4. A bracket assembly comprising:

a baluster comprising an upper end, a lower end, and a shaft between said upper end and said lower end;

a first mounting bracket comprising:

a first mounting plate configured to attach to a first railing support surface; and a first collar pivotally attached to said first mounting plate, said first collar comprising a collar bottom wall, a first collar side wall extending perpendicularly from said collar bottom wall and two laterally opposed collar side walls extending perpendicularly from said first collar side wall and said collar bottom wall, wherein a protrusion is formed on an outer surface of each of said side walls, and a collar open side disposed between said laterally opposed collar side walls opposite said first collar side wall and an open collar top opposite said bottom wall, wherein said collar side walls and said collar bottom wall define an interior area comprising a shape suitable to receive at least one of said lower end and said upper end of said baluster;

a first clip comprising a first clip side wall, two laterally opposed clip side walls extending perpendicularly from said first clip side wall, and a clip open side disposed between said laterally opposed clip side walls opposite said first clip side wall, wherein said laterally opposed clip side walls are configured to matingly engage with said protrusions on said laterally opposed collar side walls and at least partially cover said laterally opposed collar side walls such that said first clip side wall substantially covers said collar open side; and, a first shoe slidably coupled to at least one of said lower end and said upper end of said baluster for covering and configured to cover said first mounting bracket.

5. The bracket assembly of claim 4, further comprising:

a second mounting bracket comprising:

a second mounting plate configured to attach to a second railing support surface opposite said first railing support surface; and a second collar pivotally attached to said second mounting plate, said second collar comprising a collar bottom wall, a first collar side wall extending perpendicularly from said collar bottom wall and two laterally opposed collar side walls extending perpendicularly from said first collar side wall and said collar bottom wall, wherein a protrusion is formed on an outer surface of each of said laterally opposed collar side walls, and a collar open side disposed between said laterally opposed collar side walls opposite said first collar side wall and an open collar top opposite said bottom wall, said collar side walls and said collar bottom wall define an interior area comprising a shape suitable to receive at least one of said lower end and said upper end of said baluster;

a second clip comprising a first clip side wall, two laterally opposed clip side walls extending perpendicularly from said first clip side wall, and a clip open side disposed between said laterally opposed clip side walls opposite said first clip side wall, wherein said laterally opposed clip side walls of said second clip are configured to matingly engage with said protrusions on said laterally opposed collar side walls and at least partially cover said laterally opposed collar side walls of said second collar such that said first clip side wall substantially covers said collar open side; and, a second shoe slidably coupled to at least one of said lower end and said upper end of said baluster and configured to cover said second mounting bracket.

* * * * *

UNITED STATES PATENT AND TRADEMARK OFFICE

CERTIFICATE OF CORRECTION

PATENT NO. : 8,936,233 B1
APPLICATION NO. : 13/618304
DATED : January 20, 2015
INVENTOR(S) : Jayme M. Sneith et al.

It is certified that error appears in the above-identified patent and that said Letters Patent is hereby corrected as shown below:

TITLE PAGE:

Item 12 should read

Sneith et al.

Item 75 should read

Jayme M. Sneith, Scenery Hill, PA (US); Matthew S. Edwards, Bolivar, OH (US)

Signed and Sealed this
Third Day of November, 2015

Michelle K. Lee

Michelle K. Lee
*Director of the United States Patent and Trademark Office*